US010218065B2

(12) United States Patent
Lee et al.

(10) Patent No.: US 10,218,065 B2
(45) Date of Patent: Feb. 26, 2019

(54) ANTENNA STRUCTURE AND WIRELESS COMMUNICATION DEVICE USING SAME

(71) Applicant: Chiun Mai Communication Systems, Inc., New Taipei (TW)

(72) Inventors: Cheng-Han Lee, New Taipei (TW); Yi-Wen Hsu, New Taipei (TW); Wei-Xuan Ye, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 65 days.

(21) Appl. No.: 15/626,160

(22) Filed: Jun. 18, 2017

(65) Prior Publication Data

US 2018/0026360 A1 Jan. 25, 2018

Related U.S. Application Data

(60) Provisional application No. 62/364,303, filed on Jul. 19, 2016.

(30) Foreign Application Priority Data

Aug. 31, 2016 (CN) ..... 2016 1 0774244

(51) Int. Cl.

| | |
|---|---|
| ***H01Q 1/24*** | (2006.01) |
| ***H01Q 1/42*** | (2006.01) |
| ***H01Q 9/42*** | (2006.01) |
| ***H01Q 13/18*** | (2006.01) |
| ***H01Q 21/28*** | (2006.01) |
| ***H01Q 5/371*** | (2015.01) |
| ***H01Q 9/14*** | (2006.01) |

(Continued)

(52) U.S. Cl.

CPC ..... *H01Q 1/42* (2013.01); *H01Q 1/243* (2013.01); *H01Q 5/314* (2015.01); *H01Q 5/328* (2015.01); *H01Q 5/371* (2015.01); *H01Q 9/14* (2013.01); *H01Q 9/42* (2013.01); *H01Q 13/18* (2013.01); *H01Q 21/28* (2013.01); *H01Q 9/065* (2013.01)

(58) Field of Classification Search

CPC ..... H01Q 1/42; H01Q 9/065; H01Q 13/18; H01Q 1/24; H01Q 1/243; H01Q 1/38; H01Q 21/28; H01Q 5/314; H01Q 5/328; H01Q 5/371; H01Q 9/14; H01Q 9/42

See application file for complete search history.

(56) References Cited

U.S. PATENT DOCUMENTS 6,879,293 B2 * 4/2005 Sato ..... G06F 1/1616 343/700 MS
9,331,397 B2 * 5/2016 Jin ..... H01Q 21/28

(Continued)

*Primary Examiner* — Tho G Phan
(74) *Attorney, Agent, or Firm* — ScienBiziP, P.C.

(57) ABSTRACT

An antenna structure includes a metallic member, a first radiator, and an isolating portion. The metallic member includes a front frame, a backboard, and a side frame. The side frame includes at least a top portion, a first side portion, and a second side portion. The isolating portion is electrically connected to the first radiator. The side frame defines a slot and the slot is defined on the top portion. The front frame defines a gap. The gap communicates with the slot and extends across the front frame. The first portion of the front frame from a first side of the gap to a first end of the slot forms a short portion. The first radiator is positioned adjacent to the short portion and the isolation portion improves isolation between the short portion and the first radiator.

41 Claims, 26 Drawing Sheets

(51) Int. Cl.

| | |
|---|---|
| ***H01Q 5/314*** | (2015.01) |
| ***H01Q 5/328*** | (2015.01) |
| *H01Q 9/06* | (2006.01) |

(56) References Cited

U.S. PATENT DOCUMENTS

| | | | | |
|---|---|---|---|---|
| 9,379,427 | B2 * | 6/2016 | Xu | H01Q 1/243 |
| 9,647,320 | B2 * | 5/2017 | Lin | H01Q 1/243 |
| 9,647,332 | B2 * | 5/2017 | Han | H01Q 1/50 |
| 9,774,075 | B2 * | 9/2017 | Nishizaka | H01Q 1/243 |
| 9,859,609 | B2 * | 1/2018 | Chiang | H01Q 1/243 |

* cited by examiner

ANTENNA STRUCTURE AND WIRELESS COMMUNICATION DEVICE USING SAME

CROSS-REFERENCE TO RELATED APPLICATIONS

This application claims priority to Chinese Patent Application No. 201610774244.4 filed on Aug. 31, 2016, and claims priority to U.S. Patent Application No. 62/364,303, filed on Jul. 19, 2016, the contents of which are incorporated by reference herein.

FIELD

The subject matter herein generally relates to an antenna structure and a wireless communication device using the antenna structure.

BACKGROUND

Metal housings, for example, metallic backboards, are widely used for wireless communication devices, such as mobile phones or personal digital assistants (PDAs). Antennas are also important components in wireless communication devices for receiving and transmitting wireless signals at different frequencies, such as wireless signals in Long Term Evolution Advanced (LTE-A) frequency bands. However, when the antenna is located in the metal housing, the antenna signals are often shielded by the metal housing. This can degrade the operation of the wireless communication device. Additionally, the metallic backboard generally defines slots or/and gaps thereon, which will affect an integrity and an aesthetic of the metallic backboard.

BRIEF DESCRIPTION OF THE DRAWINGS

Implementations of the present technology will now be described, by way of example only, with reference to the attached figures.

DETAILED DESCRIPTION

Figure 1:
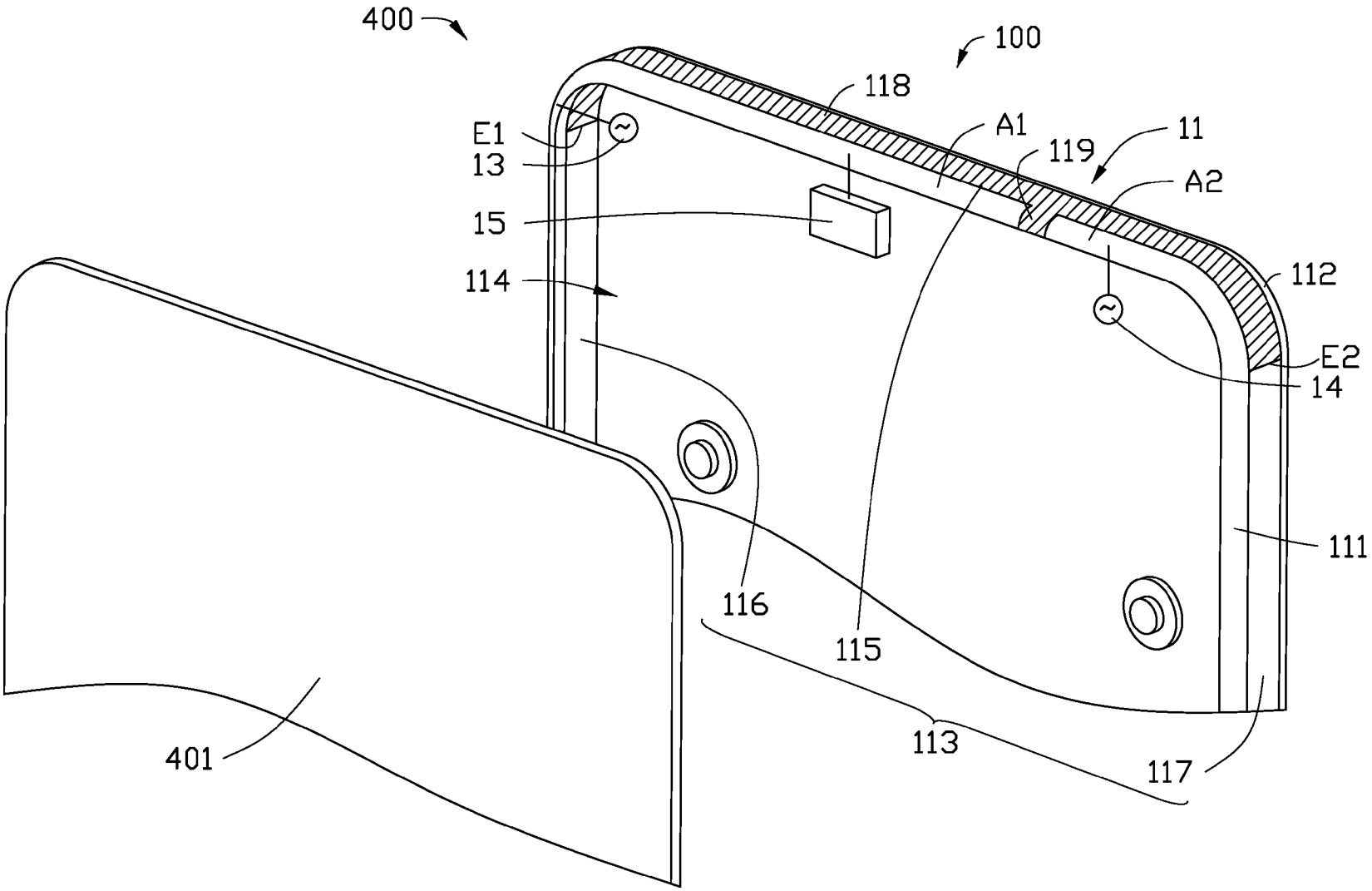
FIG. 1 is an isometric view of a first exemplary embodiment of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

FIG. 1 illustrates an embodiment of a wireless communication device 400 using a first exemplary antenna structure 100. The wireless communication device 400 can be a mobile phone or a personal digital assistant, for example. The antenna structure 100 can receive or send wireless signals.

Figure 2:
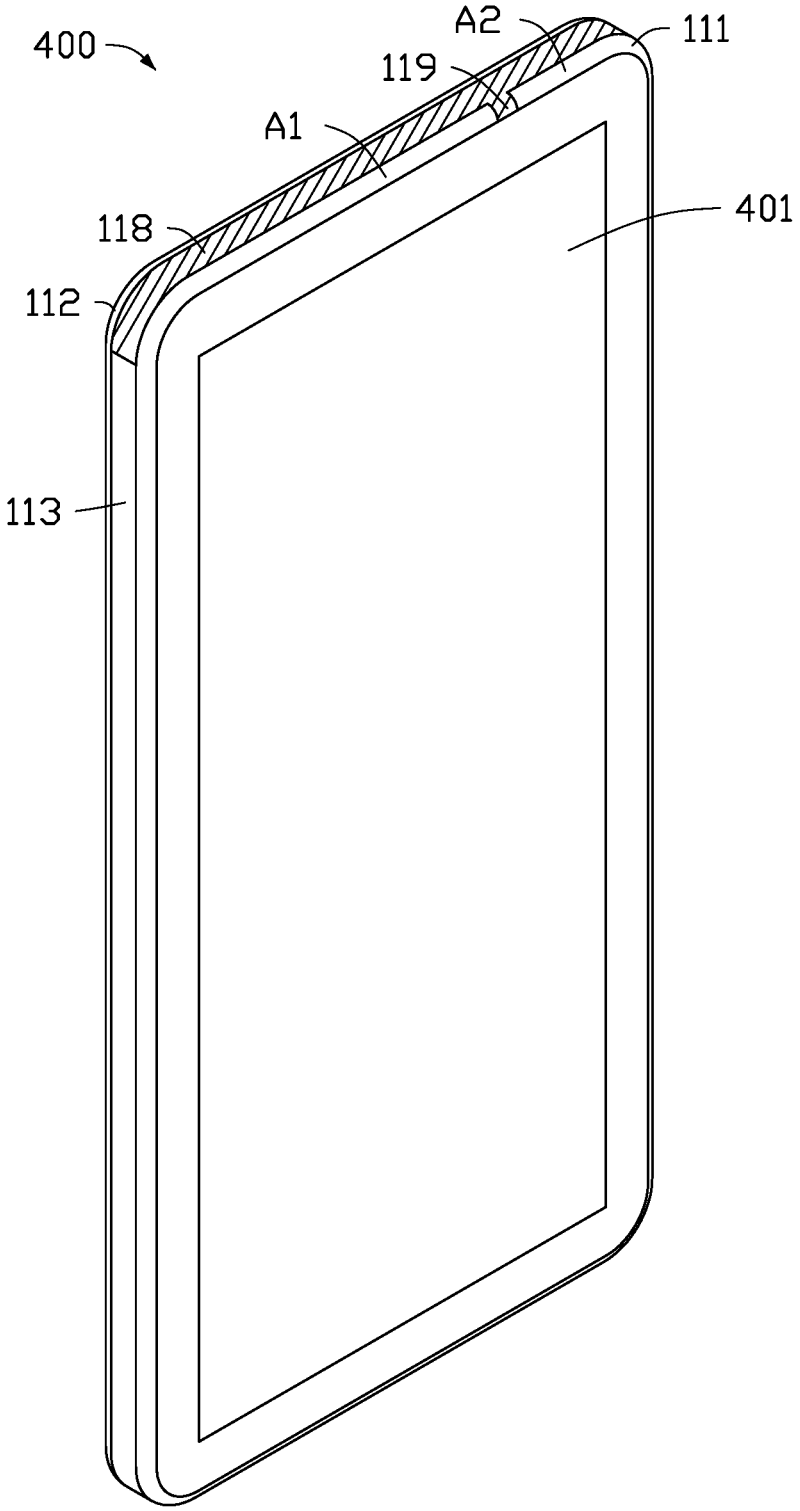
FIG. 2 is an assembled, isometric view of the wireless communication device of FIG. 1.
Figure 3:
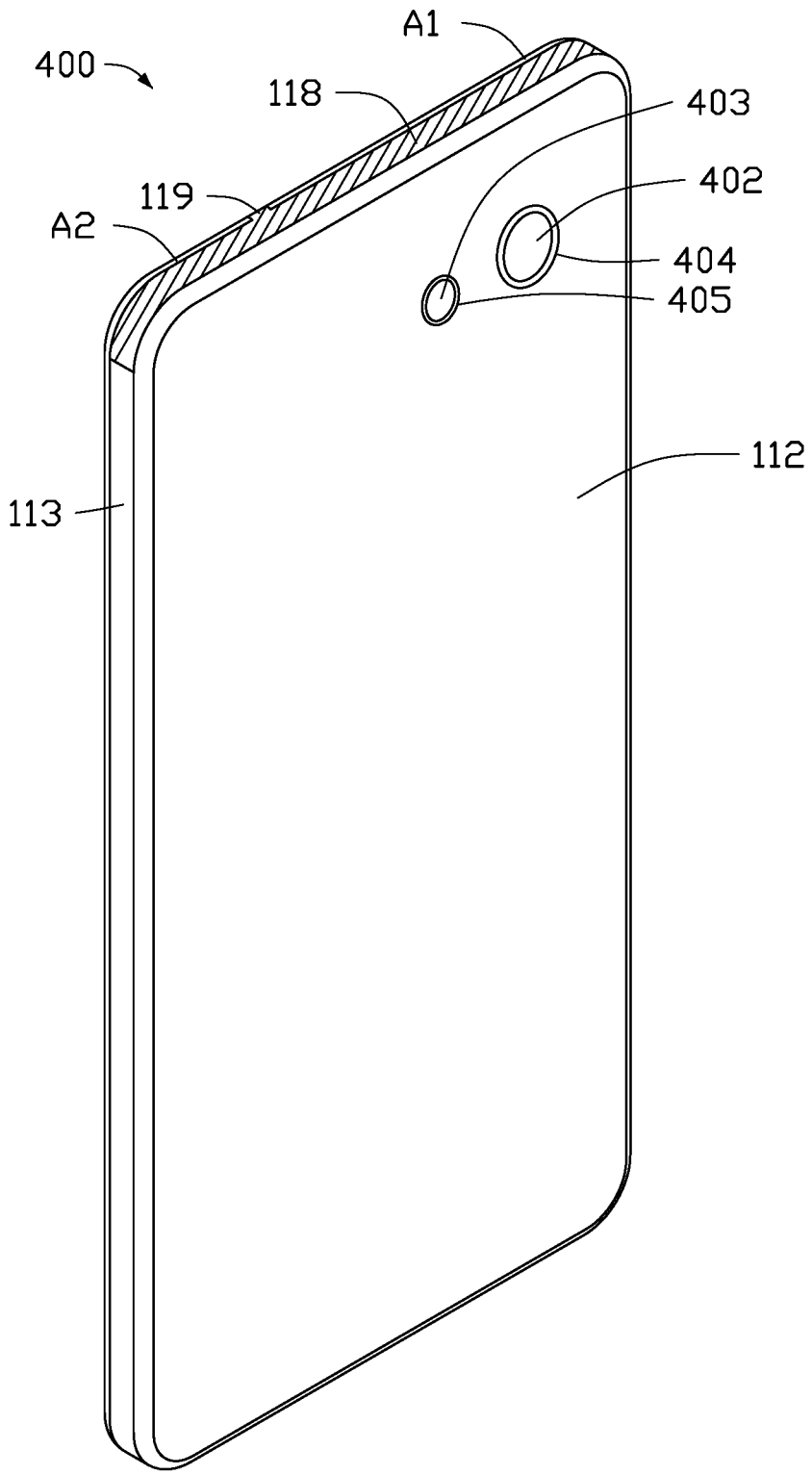
FIG. 3 is similar to FIG. 2, but shown in another angle.

Per FIG. 1, FIG. 2 and FIG. 3, the antenna structure 100 includes a metallic member 11, a first feed source 13, a second feed source 14, and a first switching circuit 15. The metallic member 11 can be a metal housing of the wireless communication device 400. In this exemplary embodiment, the metallic member 11 is a frame structure and includes a front frame 111, a backboard 112, and a side frame 113. The front frame 111, the backboard 112, and the side frame 113 can be integral with each other. The front frame 111, the backboard 112, and the side frame 113 cooperatively form the metal housing of the wireless communication device 400.

The front frame 111 defines an opening (not shown) thereon. The wireless communication device 400 includes a display 401. The display 401 is received in the opening. The display 401 has a display surface. The display surface is exposed at the opening and is positioned parallel to the backboard 112.

The backboard 112 is positioned opposite to the front frame 111. The backboard 112 is an integral and single metallic sheet. Except the holes 404, 405 for exposing a camera lens 402 and a flash light 403, the backboard 112 does not define any other slot, break line, and/or gap. The backboard 112 serves as a ground of the antenna structure 100.

The side frame 113 is positioned between the front frame 111 and the backboard 112. The side frame 113 is positioned around a periphery of the front frame 111 and a periphery of the backboard 112. The side frame 113 forms a receiving space 114 together with the display 401, the front frame 111, and the backboard 112. The receiving space 114 can receive a print circuit board, a processing unit, or other electronic components or modules.

The side frame 113 includes a top portion 115, a first side portion 116, and a second side portion 117. The top portion 115 connects the front frame 111 and the backboard 112. The first side portion 116 is positioned apart from and parallel to the second side portion 117. The top portion 115 has first and second ends. The first side portion 116 is connected to the first end of the first frame 111 and the second side portion 117 is connected to the second end of the top portion 115. The first side portion 116 connects the front frame 111 and the backboard 112. The second side portion 117 also connects the front frame 111 and the backboard 112.

The side frame 113 defines a slot 118. The front frame 111 defines a gap 119. In this exemplary embodiment, the slot 118 is defined at the top portion 115 and extends to the first side portion 116 and the second portion 117. In other exemplary embodiments, the slot 118 can only be defined at the top portion 115 and does not extend to any one of the first side portion 116 and the second portion 117. In other exemplary embodiments, the slot 118 can be defined at the top portion 115 and extends to one of the first side portion 116 and the second portion 117. The gap 119 communicates with the slot 118 and extends across the front frame 111. In this exemplary embodiment, the gap 119 is positioned adjacent to the second side portion 117. The front frame 111 is divided into two portions by the gap 119, that is, a long portion A1 and a short portion A2 (long and short relative to each other). A first portion of the front frame 111 from a first side of the gap 119 to a first end E1 of the slot 118 forms the long portion A1. A second portion of the front frame 111 from a second side of the gap 119 to a second end E2 of the slot 118 forms the short portion A2.

In this exemplary embodiment, the gap 119 is not positioned at a middle portion of the top portion 115. The long portion A1 is longer than the short portion A2.

In this exemplary embodiment, the slot 118 and the gap 119 are both filled with insulating material, for example, plastic, rubber, glass, wood, ceramic, or the like, thereby isolating the long portion A1, the short portion A2, and the backboard 112.

In this exemplary embodiment, except for the slot 118 and the gap 119, an upper half portion of the front frame 111 and the side frame 113 does not define any other slot, break line, and/or gap. That is, there is only one gap 119 defined on the upper half portion of the front frame 111.

The first feed source 13 is electrically connected to the end of the long portion A1 adjacent to the first side portion 116. The first feed source 13 can feed current to the long portion A1 and activates the long portion A1 to a first mode to generate radiation signals in a first frequency band. In this exemplary embodiment, the first mode is a low frequency operation mode. The first frequency band is a frequency band of about 700-900 MHz.

The second feed source 14 is electrically connected to the end of the short portion A2 adjacent to the gap 119. The second feed source 14 can feed current to the short portion A2 and activate the short portion A2 to two modes to generate radiation signals in a wide band mode (1710-2690 MHz). The wide band mode can contain a middle frequency operation mode, a high frequency operation mode, and a WIFI 2.4G band.

Figure 4:
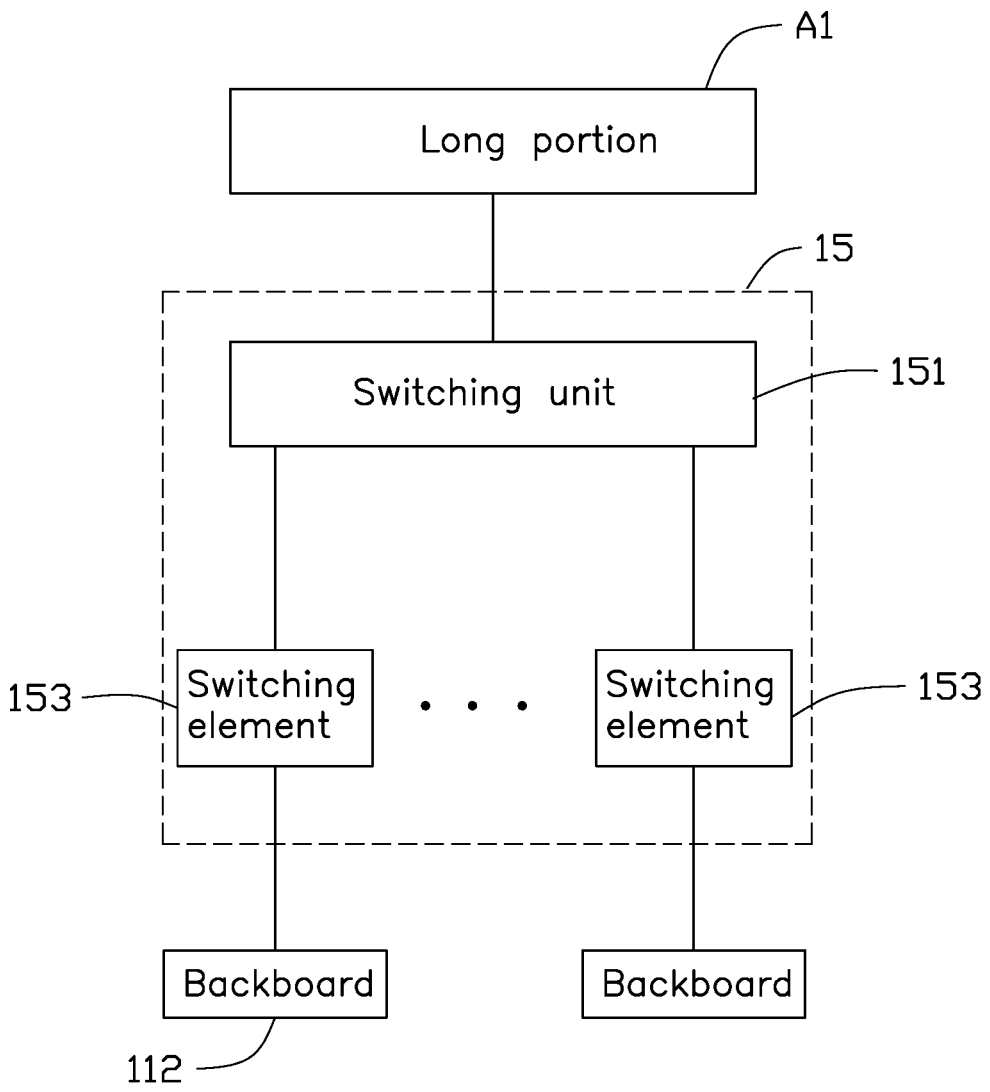
FIG. 4 is a circuit diagram of a first switching circuit of the antenna structure of FIG. 1.

Per FIG. 4, the first switching circuit 15 is electrically connected to the long portion A1. The first switching circuit 15 includes a switching unit 151 and a plurality of switching elements 153. The switching unit 153 is electrically connected to the long portion A1. The switching elements 153 can be an inductor, a capacitor, or a combination of the inductor and the capacitor. The switching elements 153 are connected in parallel to each other. One end of each switching element 153 is electrically connected to the switching unit 151. The other end of each switching element 153 is electrically connected to the backboard 112. Through controlling the switching unit 151, the long portion A1 can be switched to connect with different switching elements 153. Since each switching element 153 has a different impedance, an operating frequency band of the long portion A1 can be adjusted through switching the switching unit 151, for example, the frequency band of the first mode of the long portion A1 can be offset towards a lower frequency or towards a higher frequency (relative to each other).

Figure 5:
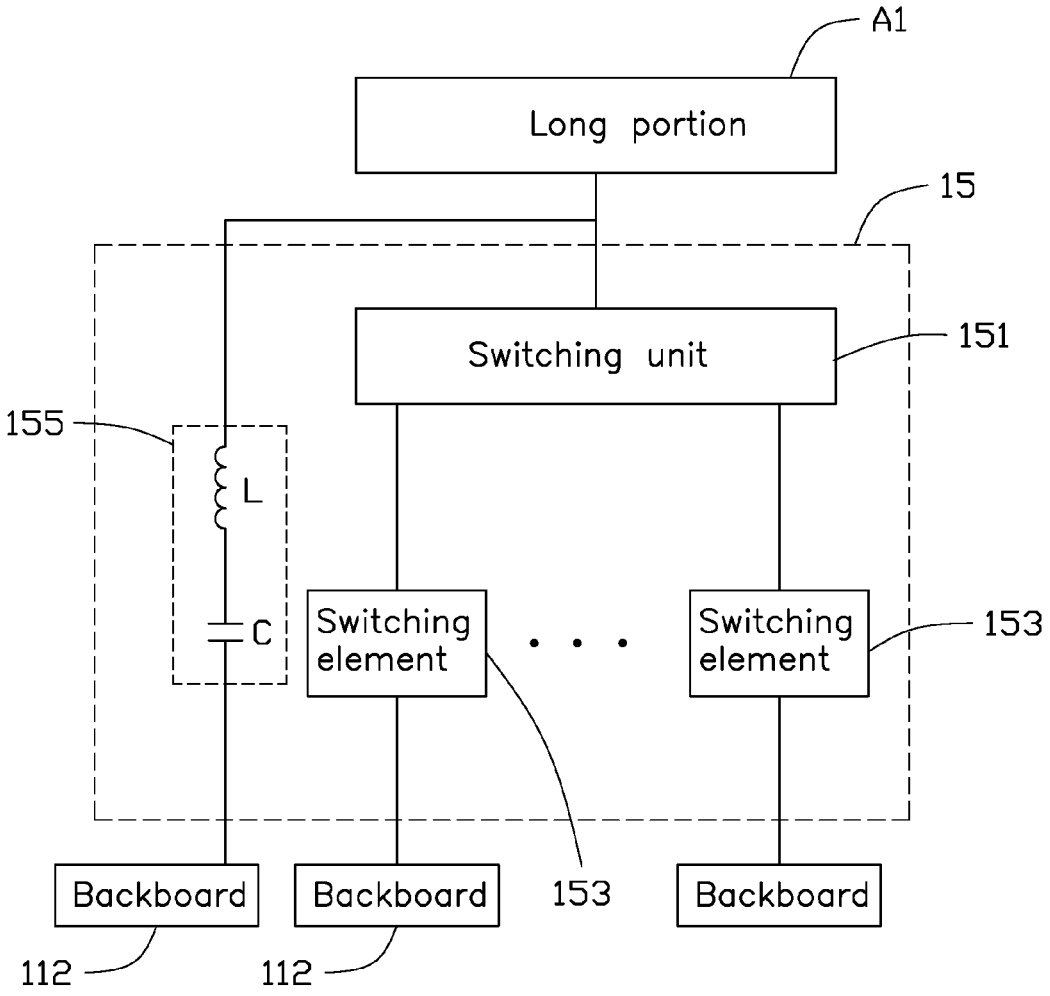
FIG. 5 is a circuit diagram of the first switching circuit of FIG. 4, showing the first switching circuit includes a resonance circuit.
Figure 6:
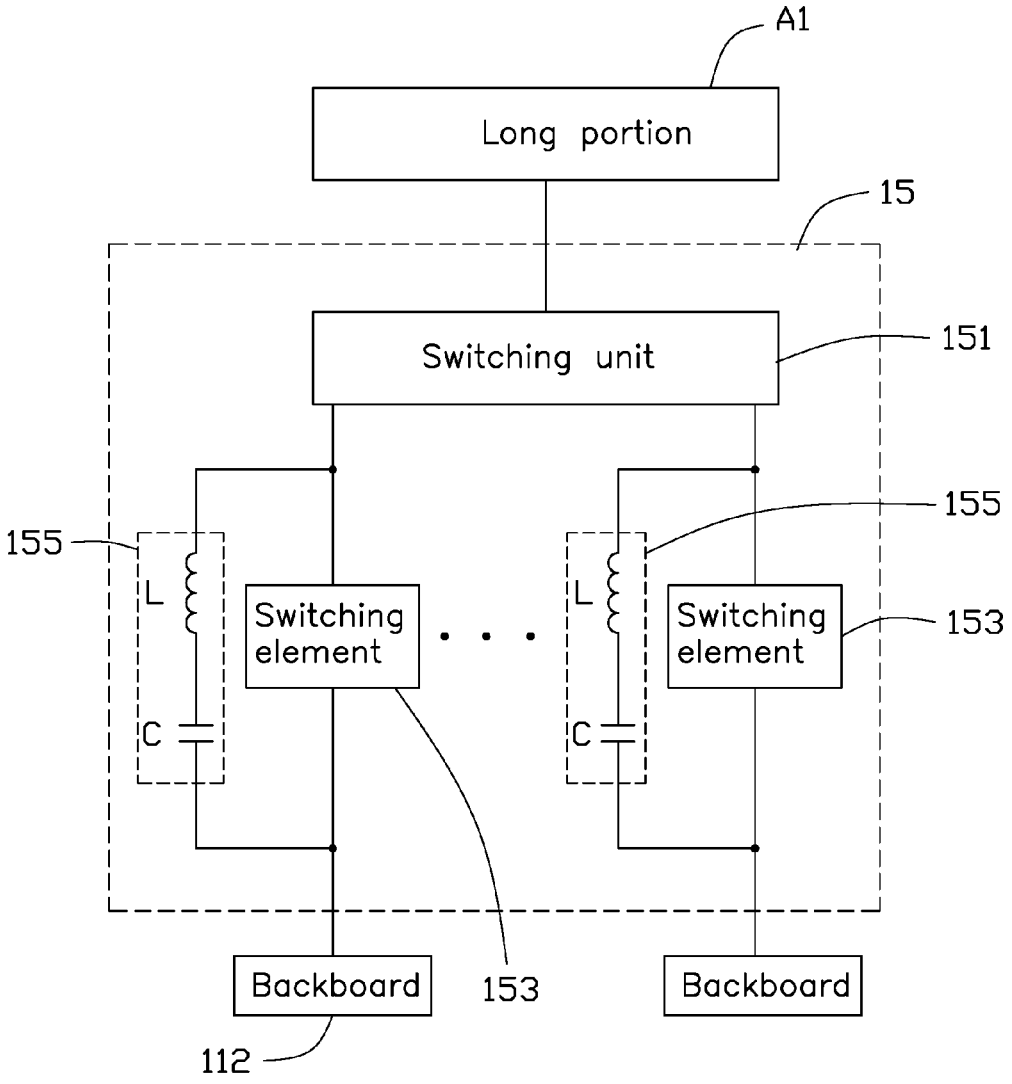
FIG. 6 is similar to FIG. 5, but shown the first switching circuit includes another resonance circuit.

Per FIG. 5 and FIG. 6, the first switching circuit 15 further includes a resonance circuit 155. Per FIG. 5, in one exemplary embodiment, the first switching circuit 15 includes one resonance circuit 155. The resonance circuit 155 includes an inductor L and a capacitor C connected in series. The resonance circuit 155 is electrically connected between the long portion A1 and the backboard 112.

Per FIG. 6, in another exemplary embodiment, the first switching circuit 15 includes a plurality of resonance circuits 155. The number of the resonance circuits 155 is equal to the number of switching elements 153. Each resonance circuit 155 includes an inductor L and a capacitor C connected in series. Each resonance circuit 155 is electrically connected to one of the switching elements 153 in parallel between the switching unit 151 and the backboard 112.

Figure 7:
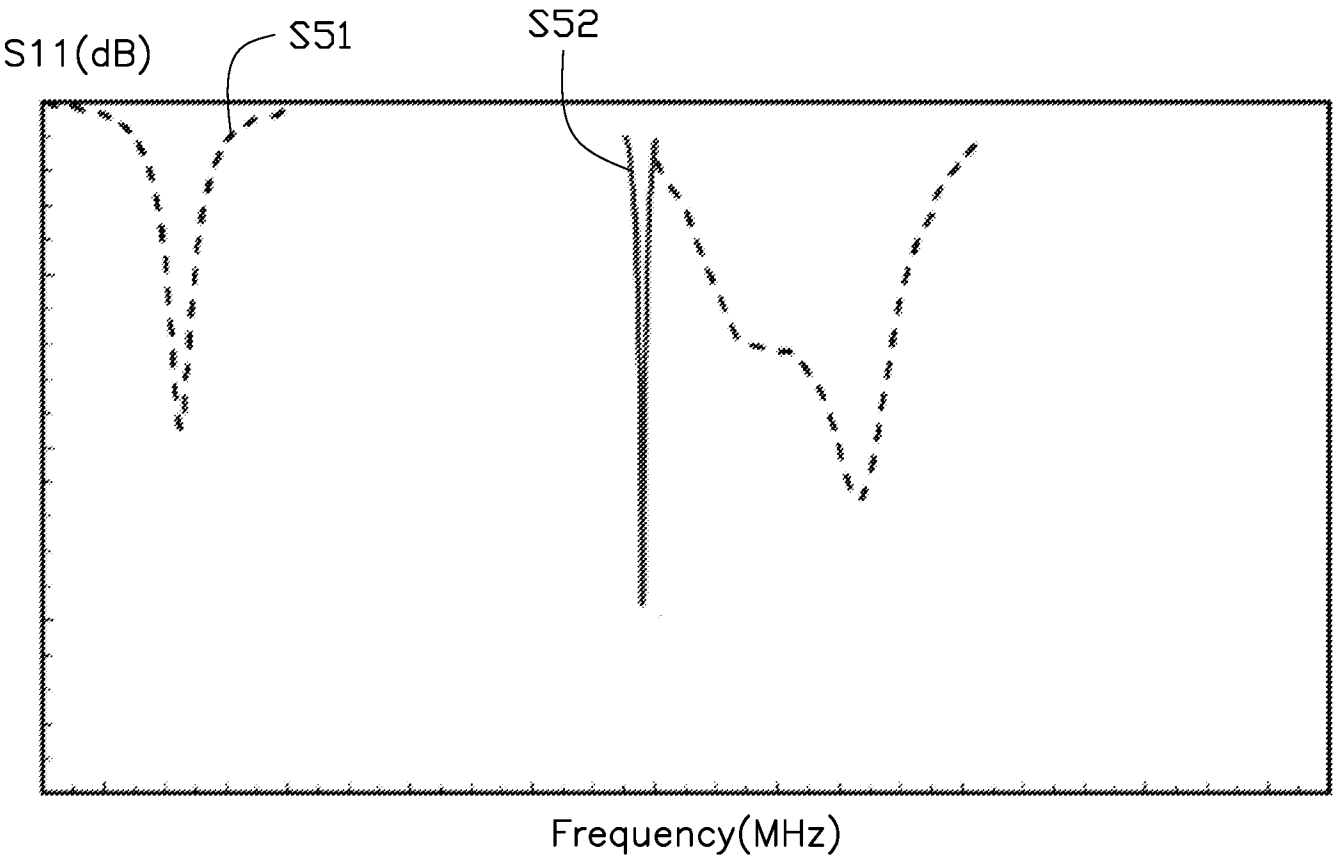
FIG. 7 is a schematic diagram of the antenna structure of FIG. 1, showing the first switching circuit of FIG. 5 includes a resonance circuit and generates a resonance mode.

Per FIG. 7, when the first switching circuit 15 does not include the resonance circuit 155, the antenna structure 100 works at the first mode (please see the curve S51). When the first switching circuit 15 includes the resonance circuit 155, the long portion A1 of the antenna structure 100 can activate an additional resonance mode (that is, the second mode, please see the curve S52) to generate radiation signals in the second frequency band. The second mode can effectively broaden an applied frequency band of the antenna structure 100. In one exemplary embodiment, the second frequency band is a GPS operation band and the second mode is the GPS resonance mode.

Figure 8:
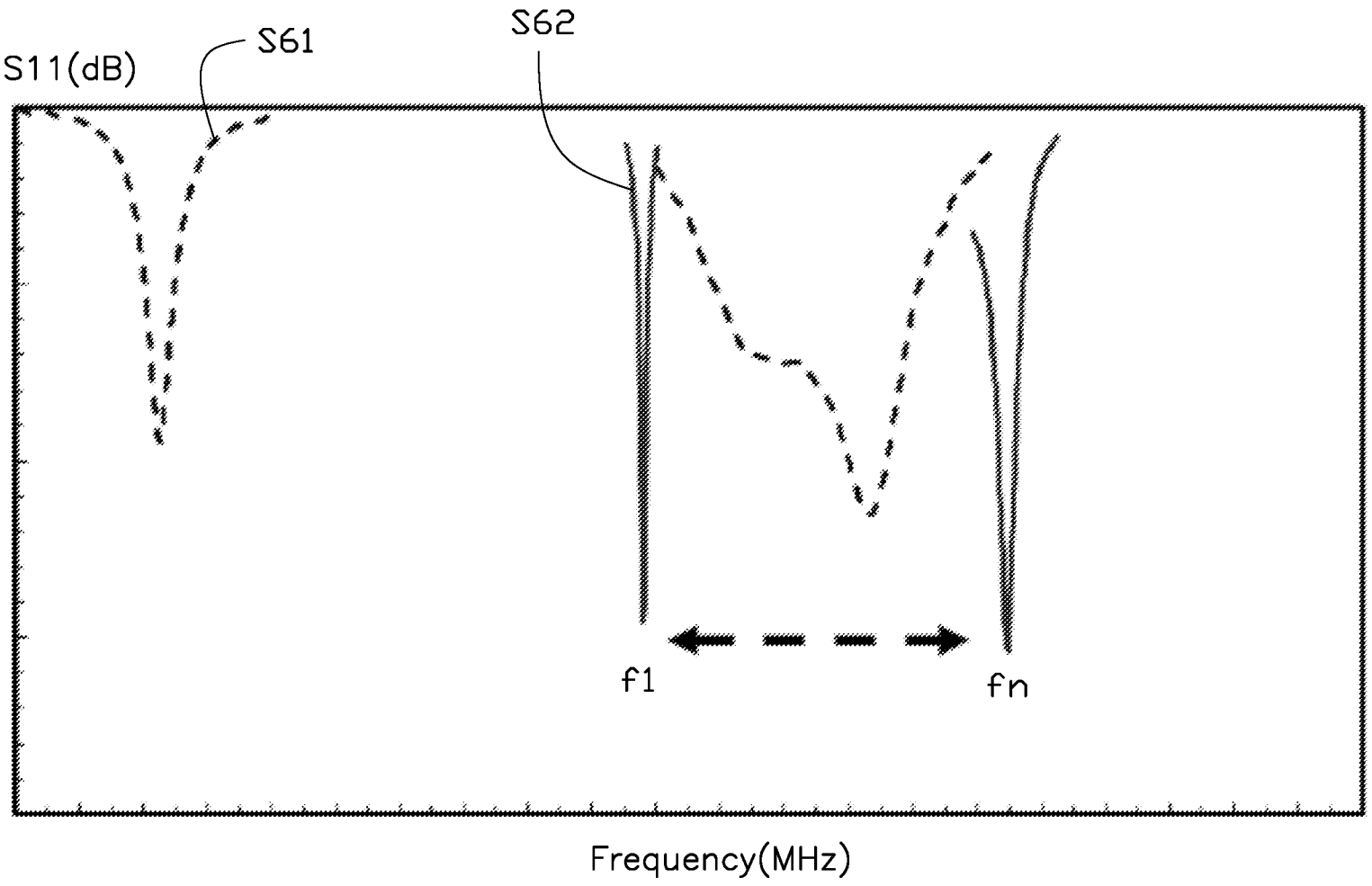
FIG. 8 is a schematic diagram of the antenna structure of FIG. 1, showing the first switching circuit of FIG. 6 includes a resonance circuit and generates a resonance mode.

Per FIG. 8, when the first switching circuit 15 does not include the resonance circuit 155, the antenna structure 100 works at the first mode (please see the curve S61). When the first switching circuit 15 includes the resonance circuit 155, the long portion A1 of the antenna structure 100 can activate the additional resonance mode (please see the curve S62), that is, the GPS resonance mode. The resonance mode can effectively broaden an applied frequency band of the antenna structure 100. In one exemplary embodiment, an inductance value of the inductor L and a capacitance value of the capacitor C of the resonance circuit 155 can cooperatively decide a frequency band of the resonance mode when the first mode switches. For example, in one exemplary embodiment, as illustrated in FIG. 8, when the switching unit 151 switches to different switching elements 153 through setting the inductance value and the capacitance value of the resonance circuit 155, the resonance mode of the antenna structure 100 can also be switched. For example, the resonance mode of the antenna structure 100 can be moved from f1 to fn.

In other exemplary embodiments, the frequency band of the resonance mode can be fixed through setting the inductance value and the capacitance value of the resonance circuit 155. Then no matter to which switching element 153 the switching unit 151 is switched, the frequency band of the resonance mode is fixed and keeps unchanged.

In other exemplary embodiments, the resonance circuit 155 is not limited to include the inductor L and the capacitor C, and can include other resonance components.

Figure 9:
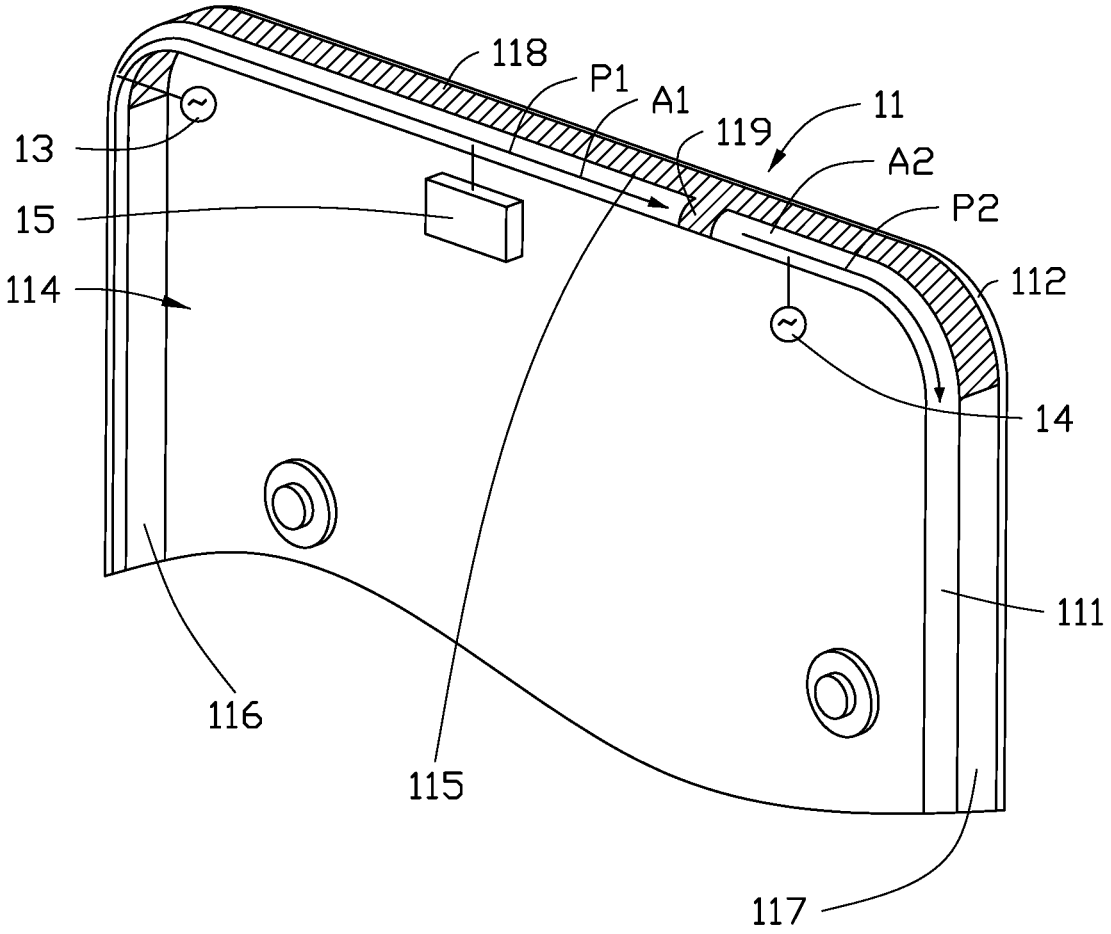
FIG. 9 is a current path distribution graph when the antenna structure of FIG. 1 works at a low frequency operation mode and a Global Positioning System (GPS) operation mode.

Per FIG. 9, when the current enters the long portion A1 from the first feed source 13, the current flows through the long portion A1 and towards the gap 119 (please see a path P1) to activate the low frequency operation mode. Since the antenna structure 100 includes the first switching circuit 15, the low frequency operation mode of the long portion A1 can be switched through the first switching circuit 15. Since the first switching circuit 15 includes the resonance circuit 155, the low frequency operation mode and the GPS operation mode can be active simultaneously. In this exemplary embodiment, a total current of the GPS operation mode is contributed by two current sources. One current source is from the low frequency operation mode (Per the path P1). The other current source is from the inductor L and the capacitor C of the resonance circuit 155 being impedance matched (Per path P2). In this exemplary embodiment, a current of the path P2 flows to one end of the short portion A2 away from the second feed source 14 from the other end of the short portion A2 adjacent to the second feed source 14.

Figure 10:
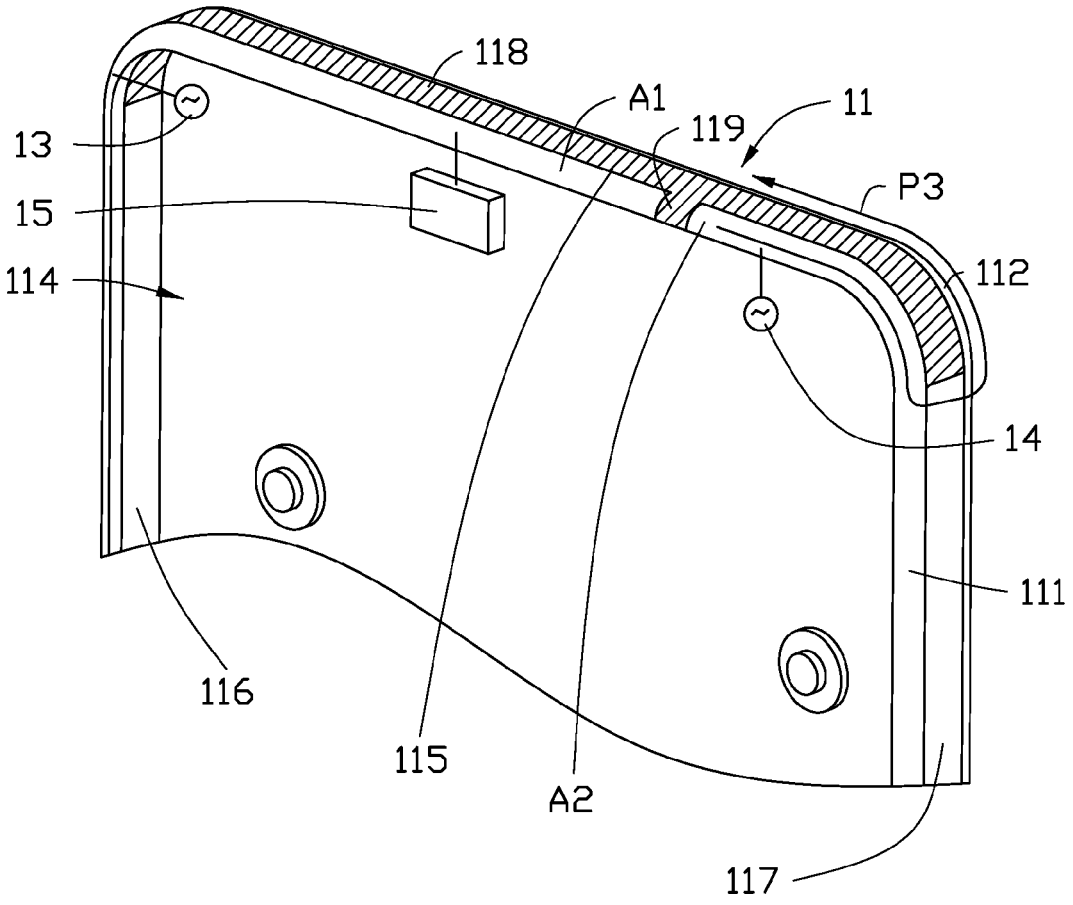
FIG. 10 is a current path distribution graph when the antenna structure of FIG. 1 works at a frequency band of about 1710-2690 MHz.

Per FIG. 10, when the current enters the short portion A2 from the second feed source 14, the current flows to the front frame 111, the second side portion 117, and the backboard 112 (Per path P3) to activate a third mode for generating radiation signals in a third frequency band (1710-2690 MHz) and containing the middle frequency operation mode, the high frequency operation mode, and the WIFI 2.4G band. From FIG. 4 to FIG. 10, the backboard 112 serves as the ground of the antenna structure 100.

Figure 11:
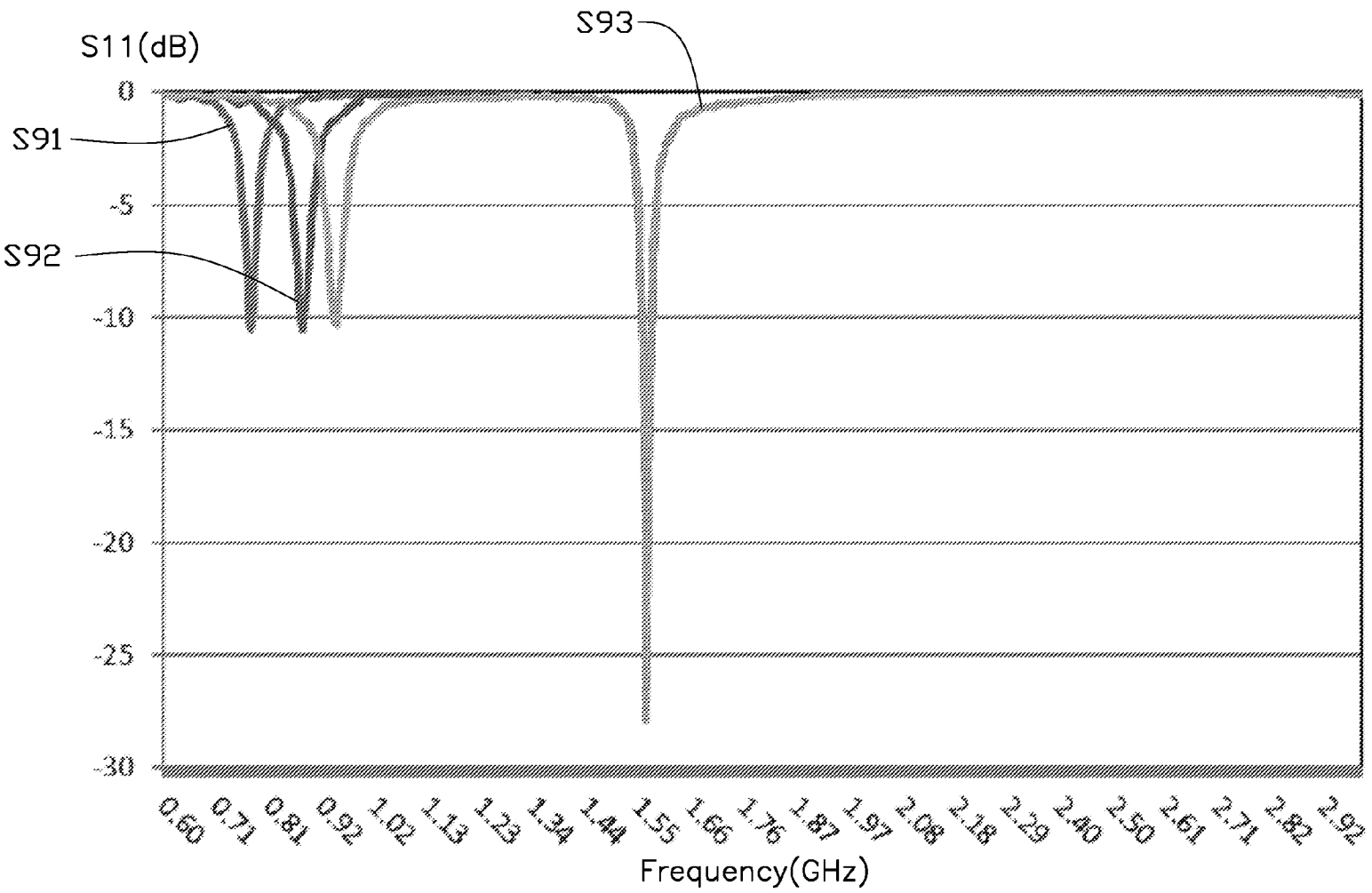
FIG. 11 is a scattering parameter graph when the antenna structure of FIG. 1 works at a low frequency operation mode and a GPS operation mode.

FIG. 11 illustrates a scattering parameter graph of the antenna structure 100, when the antenna structure 100 works at the low frequency operation mode and the GPS operation mode. Curve 91 illustrates a scattering parameter when the antenna structure 100 works at a LTE-A Band 28 (703-803 MHz). Curve 92 illustrates a scattering parameter when the antenna structure 100 works at a LTE-A Band 5 (869-894 MHz). Curve 93 illustrates a scattering parameter when the antenna structure 100 works at a LTE-A Band 8 (925-926 MHz MHz) and the GPS band (1.575 GHz). In this exemplary embodiment, curve 91 and curve 92 respectively correspond to two different frequency bands and respectively correspond to two of the plurality of low frequency bands of the switching circuit 15.

Figure 12:
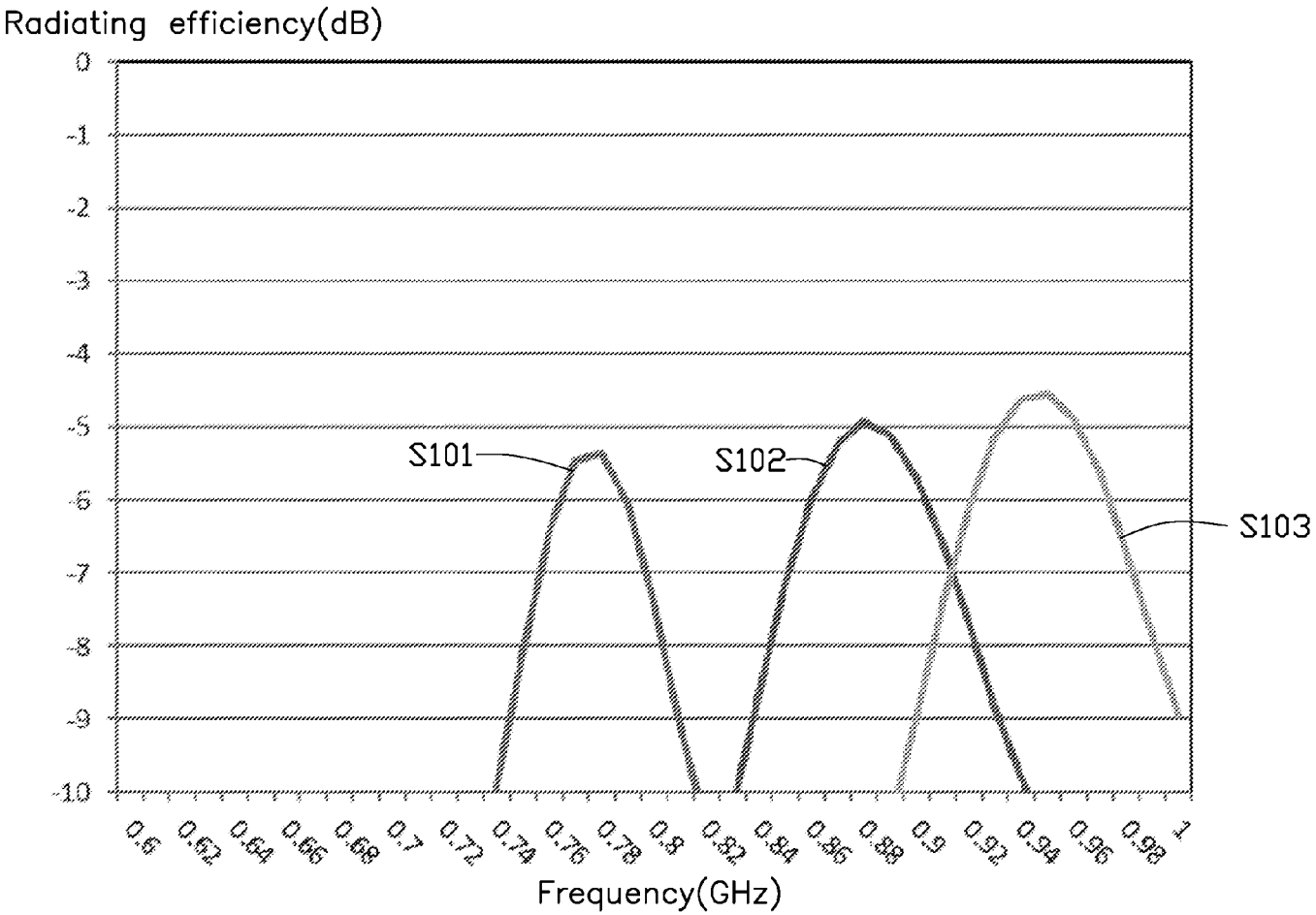
FIG. 12 is a radiating efficiency graph when the antenna structure of FIG. 1 works at a low frequency operation mode.

FIG. 12 illustrates a radiating efficiency graph of the antenna structure 100, when the antenna structure 100 works at the low frequency operation mode. Curve 101 illustrates a radiating efficiency when the antenna structure 100 works at a LTE-A Band 28 (703-803 MHz). Curve 102 illustrates a radiating efficiency when the antenna structure 100 works at a LTE-A Band 5 (869-894 MHz). Curve 103 illustrates a radiating efficiency when the antenna structure 100 works at a LTE-A Band 8 (925-926 MHz MHz). In this exemplary embodiment, curve 101, curve 102, and curve 103 respectively correspond to three different frequency bands and respectively correspond to three of the plurality of low frequency bands of the switching circuit 15.

Figure 13:
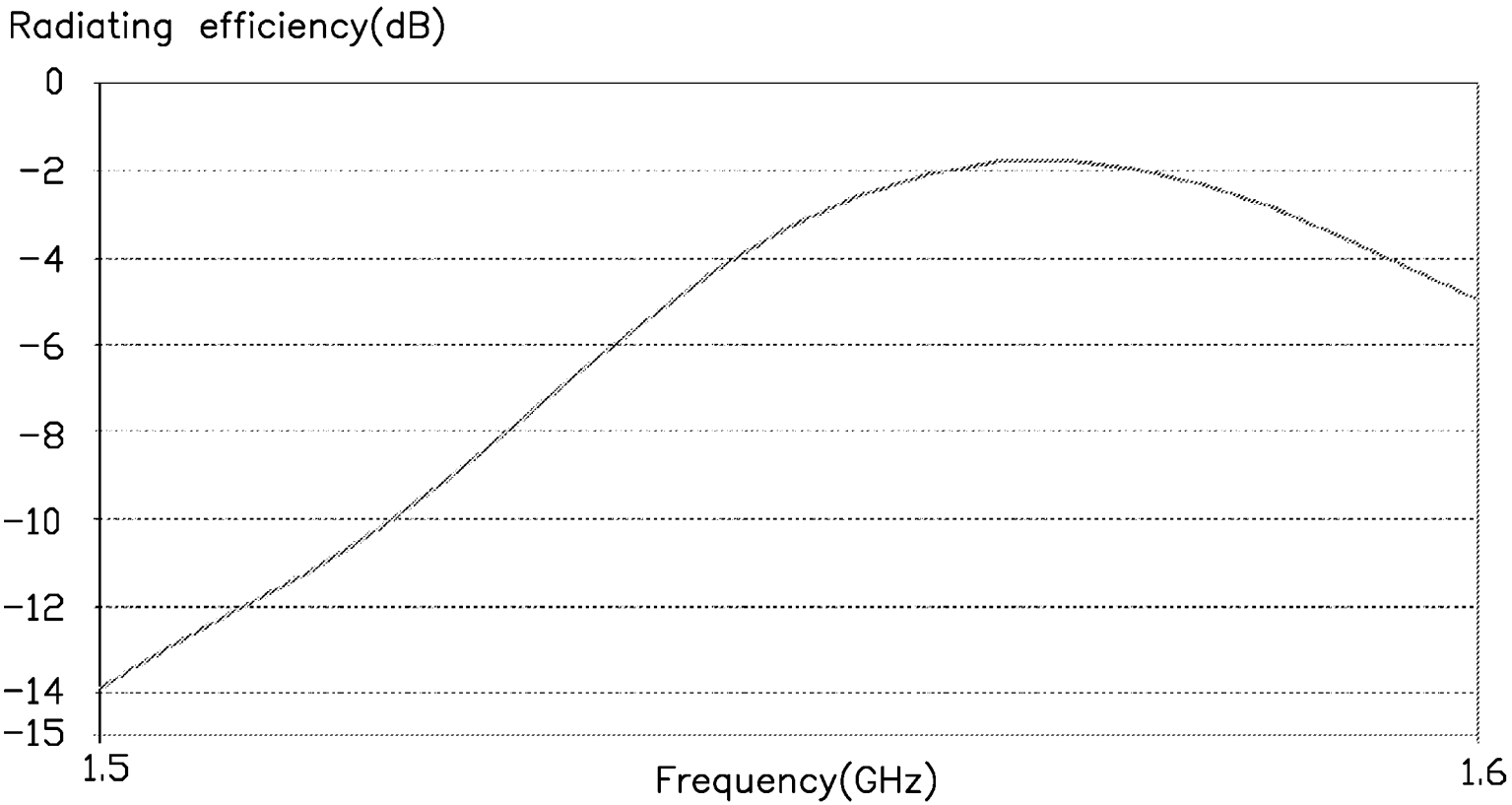
FIG. 13 is a radiating efficiency graph when the antenna structure of FIG. 1 works at a GPS operation mode.
Figure 14:
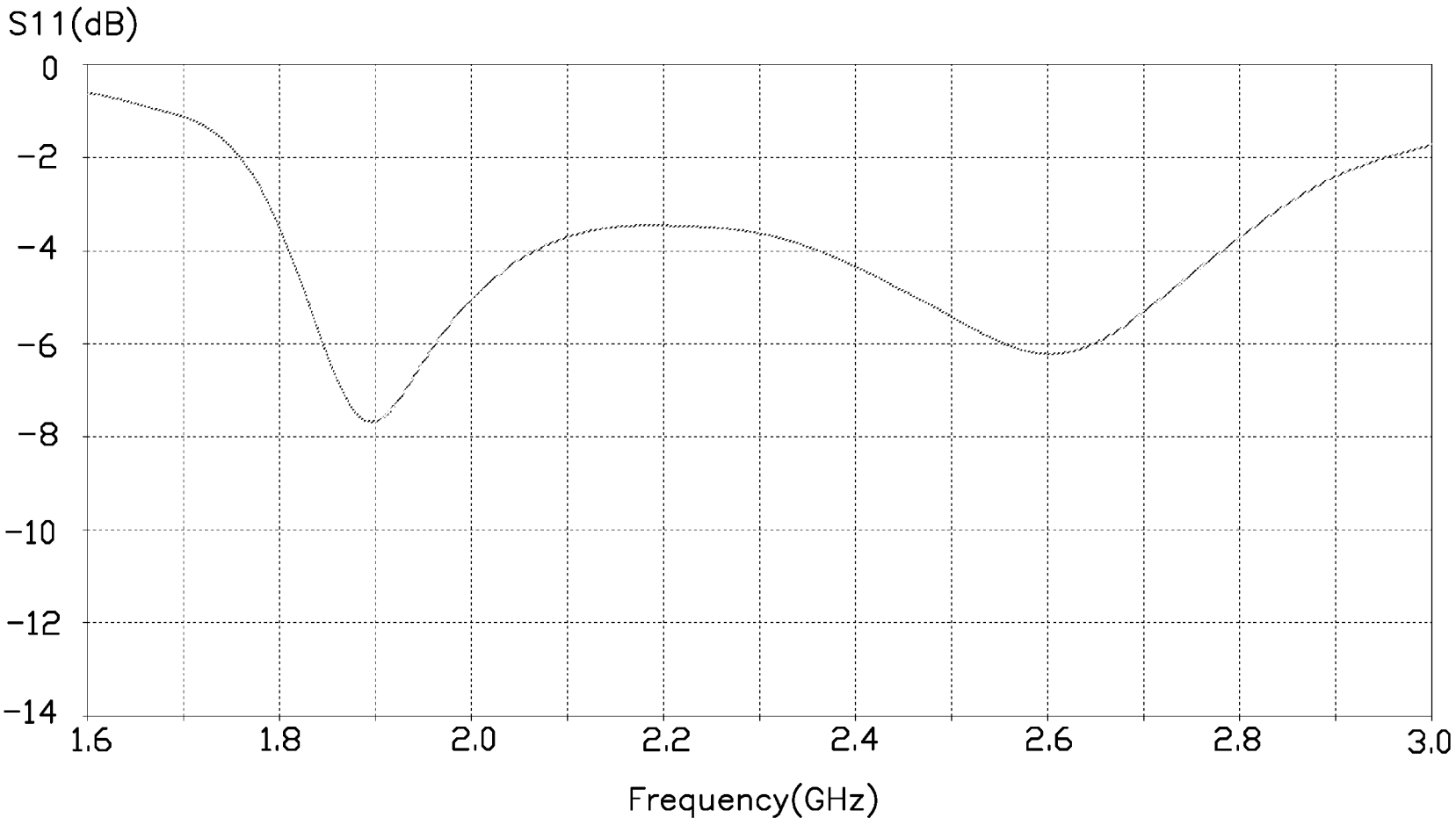
FIG. 14 is a scattering parameter graph when the antenna structure of FIG. 1 works at a frequency band of about 1710-2690 MHz.
Figure 15:
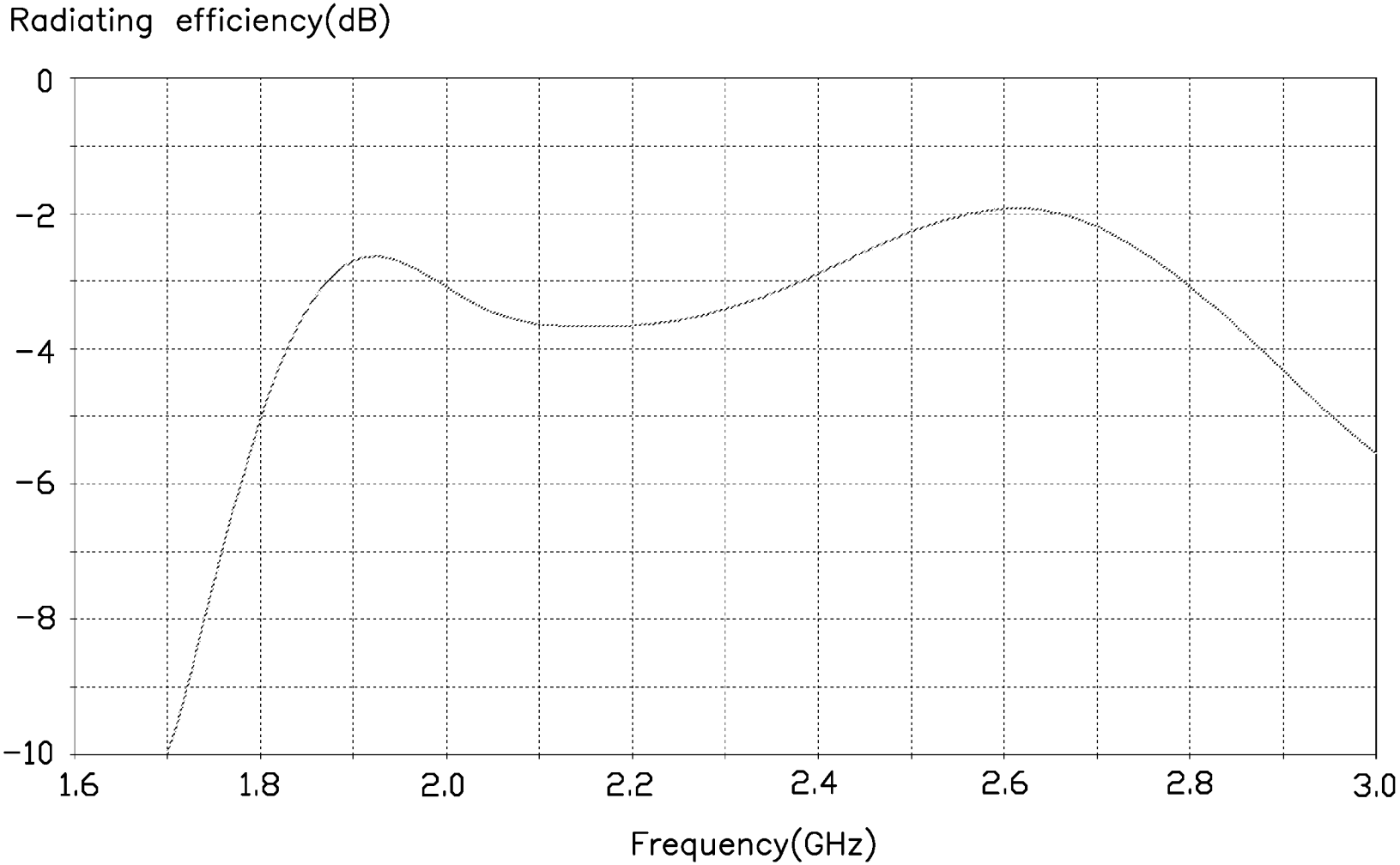
FIG. 15 is a radiating efficiency graph when the antenna structure of FIG. 1 works at a frequency band of about 1710-2690 MHz.

FIG. 13 illustrates a radiating efficiency graph of the antenna structure 100, when the antenna structure 100 works at the GPS operation mode. FIG. 14 illustrates a scattering parameter graph of the antenna structure 100, when the antenna structure 100 works at the frequency band of about 1710-2690 MHz (that is, the middle frequency operation mode, the high frequency operation mode, and the WIFI 2.4G band). FIG. 15 illustrates a radiating efficiency graph of the antenna structure 100, when the antenna structure 100 works at the frequency band of about 1710-2690 MHz (that is, the middle frequency band, the high frequency band, and the WIFI 2.4G band).

Per FIGS. 11 to 15, the antenna structure 100 can work at a low frequency band, for example, LTE-A band 28 (703-803 MHz), LTE-A Band 5 (869-894 MHz), and LTE-A Band 8 (925-926 MHz). The antenna structure 100 can also work at the GPS band (1.575 GHz) and the frequency band of about 1710-2690 MHz. That is, the antenna structure 100 can work at the low frequency band, the middle frequency band, and the high frequency band, and when the antenna structure 100 works at these frequency bands, a working frequency satisfies a design of the antenna and also has a good radiating efficiency.

Figure 16:
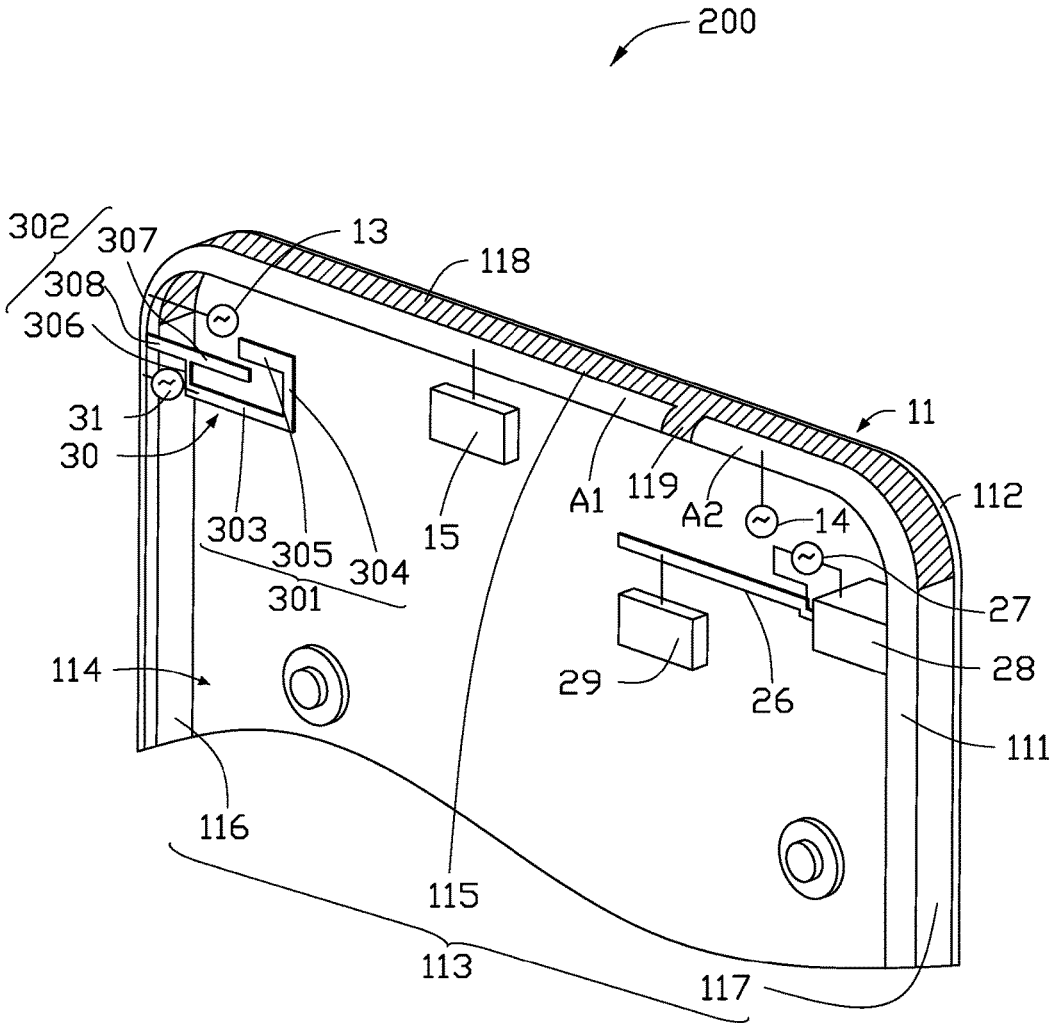
FIG. 16 is an isometric view of a second exemplary embodiment of a wireless communication device using a second exemplary antenna structure.

FIG. 16 illustrates a second exemplary embodiment of an antenna structure 200. The antenna structure 200 includes a metallic member 11, a first feed source 13, a second feed source 14, and a first switching circuit 15. The metallic member 11 includes a front frame 111, a backboard 112, and a side frame 113. The side frame 113 includes a top portion 115, a first side portion 116, and a second side portion 117. The side frame 113 defines a slot 118. The front frame 111 defines a gap 119. The front frame 111 is divided into two portions by the gap 119, that is, a long portion A1 and a short portion A2 (relative to each other). In this exemplary embodiment, the antenna structure 200 differs from the antenna structure 100 in that the antenna structure 200 further includes a first radiator 26, a third feed source 27, an isolating portion 28, a second switching circuit 29, a second radiator 30, and a fourth feed source 31.

The first radiator 26 is positioned in the receiving space 114. The first radiator 26 is positioned adjacent to the short portion A2 and is spaced apart from the backboard 112. In this exemplary embodiment, the first radiator 26 is substantially rectangular and is positioned parallel to the top portion 215. One end of the first radiator 26 is electrically connected to the isolating portion 28 and the other end of the first radiator 26 extends towards the first side portion 116. One end of the third feed source 27 is electrically connected to the first radiator 26 through a matching circuit (not shown). Another end of the third feed source 27 is electrically connected to the isolating portion 28 and feeds current to the first radiator 26.

In this exemplary embodiment, since a frequency band of the second feed source 14 approaches a frequency band of the third feed source 27, there can be interference with each other. The isolating portion 28 can extend a current path of the second feed source 14 and a current path of the third feed source 27, thereby improving isolation between the short portion A2 and the first radiator 26.

In this exemplary embodiment, the isolating portion 28 can be any shape and/or size. The isolating portion 28 can also be a planar metallic sheet and only to ensure that the isolating portion 28 can extend a current path of the third feed source 27, thereby improving isolation between the short portion A2 and the first radiator 26. For example, in this exemplary embodiment, the isolating portion 28 can be a block-shaped structure. The isolating portion 28 is positioned on the backboard 112 and extends from the second side portion 117 towards the first side portion 116.

Figure 17:
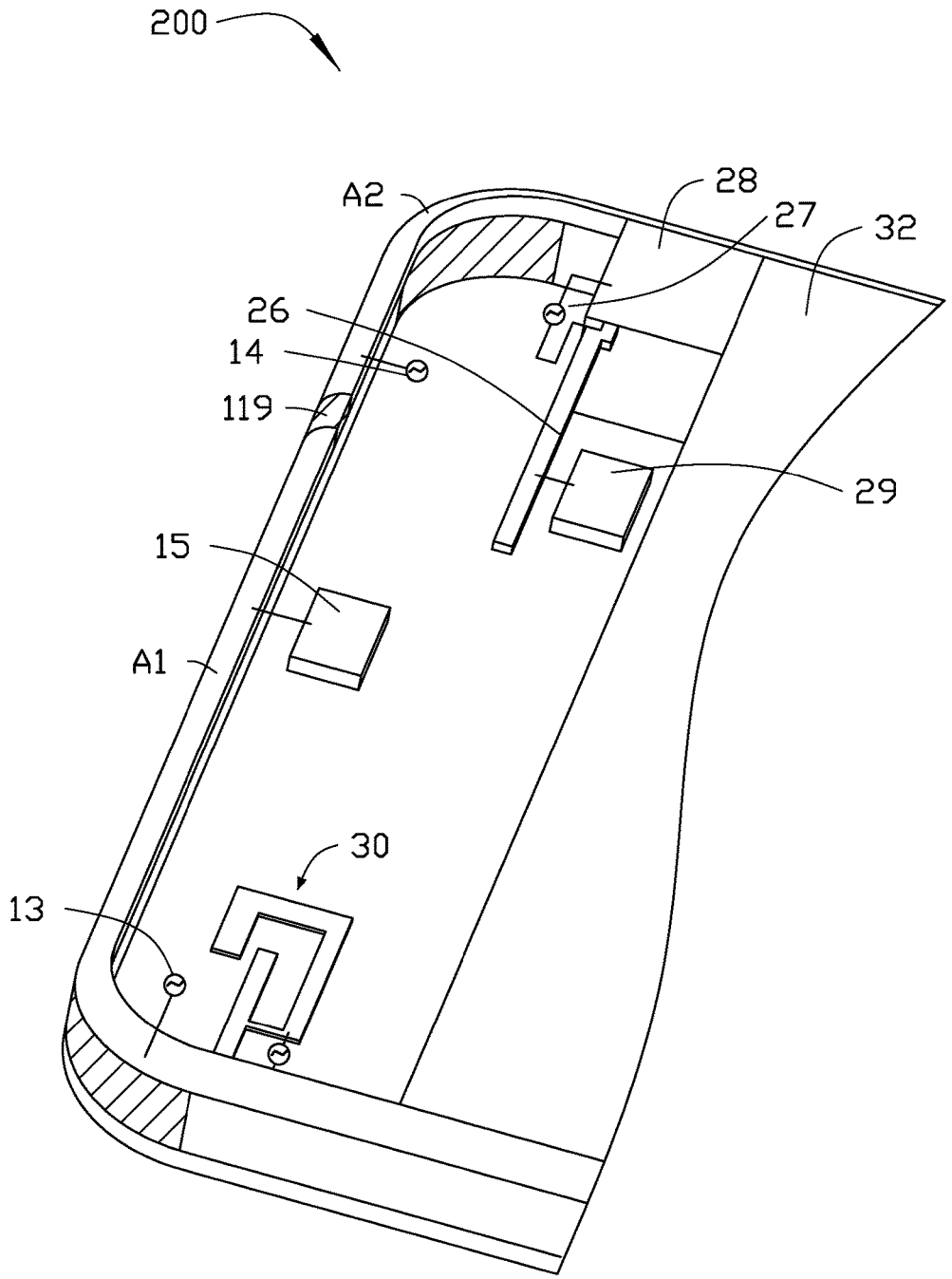
FIGS. 17 to 19 are isometric views of the antenna structure of FIG. 16, showing a location relationship of an isolation portion.

Per FIG. 17, in other exemplary embodiments, the antenna structure 200 further includes a metallic frame 32. The metallic frame 32 is positioned in the receiving space 114 and is connected to the metallic member 11. The isolating portion 28 is a block-shaped structure. The isolating portion 28 extends from the second side portion 117 towards the first side portion 116 and is connected to the metallic frame 32.

Figure 18:
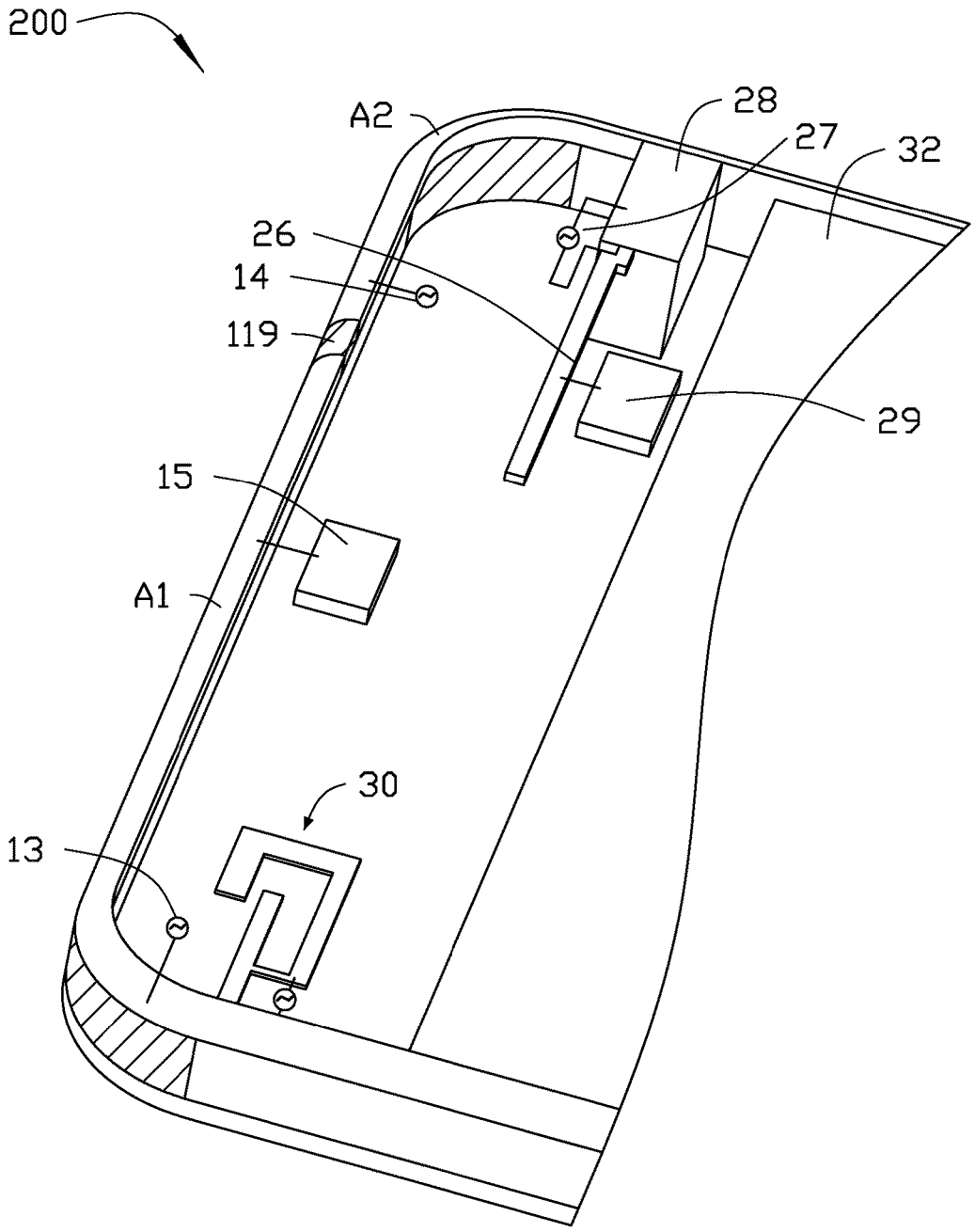

Per FIG. 18, in other exemplary embodiments, the antenna structure 200 further includes a metallic frame 32. The metallic frame 32 is positioned in the receiving space 114 and is connected to the metallic member 11. The isolating portion 28 is a block-shaped structure. The isolating portion 28 extends from the second side portion 117 towards the first side portion 116 and is spaced apart from the metallic member 11.

Figure 19:
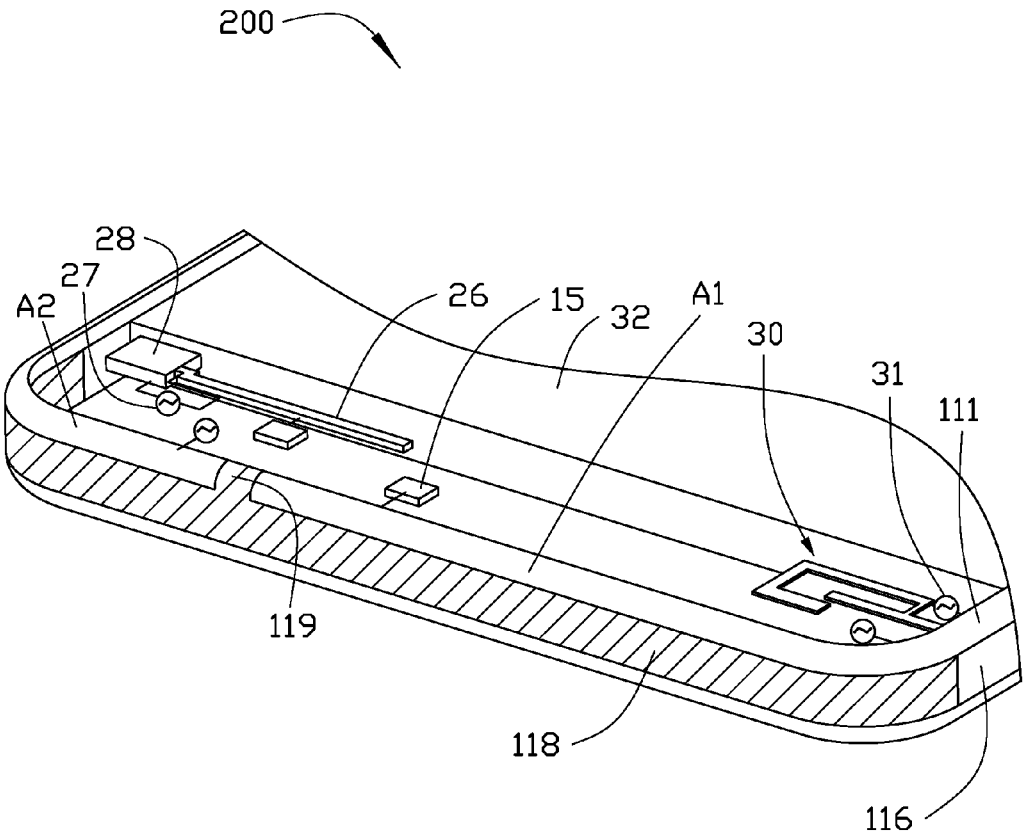

Per FIG. 19, in other exemplary embodiments, the antenna structure 200 further includes a metallic frame 32. The metallic frame 32 is positioned in the receiving space 114 and is connected to the metallic member 11. The isolating portion 28 is still block-shaped, but substantially thinner, thereby approaching a more substantially 2-dimensional rectangular shape. The isolating portion 28 is positioned at one side of the metallic frame 32. The isolating portion 28 is spaced apart from both the second side portion 117 and the backboard 112.

Per FIG. 16, one end of the second switching circuit 29 is electrically connected to the first radiator 26 and another end of the second switching circuit 29 is electrically connected to the backboard 112. The second switching circuit 29 can adjust the high frequency operation mode of the first radiator 26. The detail circuit and working principle of the second switching circuit 29 can consult a description of the first switching circuit 15 in FIG. 4.

The second radiator 30 is positioned in the receiving space 114 and is positioned adjacent to the long portion A1. In this exemplary embodiment, the second radiator 30 includes a first radiating portion 301 and a second radiating portion 302. The first radiating portion 301 is substantially U-shaped and includes a first radiating section 303, a second radiating section 304, and a third radiating section 305 connected in that order. The first radiating section 303 is substantially strip-shaped and is parallel to the top portion 215. The second radiating section 304 is substantially strip-shaped. One end of the second radiating section 304 is perpendicularly connected to one end of the first radiating section 303 adjacent to the second side portion 117. The other end of the second radiating section 304 extends along a direction parallel to the second side portion 117 and towards the top portion 115 to form an L-shaped structure with the first radiating section 303. The third radiating section 305 is substantially strip-shaped. One end of the third radiating section 305 is connected to one end of the second radiating section 304 away from the first radiating section 303. The other end of the third radiating section 305 extends along a direction parallel to the first radiating section 303 and towards the first side portion 116. The third radiating section 305 and the first radiating section 303 are positioned at a same side of the second radiating section 304 and are positioned at two ends of the second radiating section 304.

The second radiating portion 302 is substantially T-shaped and includes a first connecting section 306, a second connecting section 307, and a third connecting section 308. The first connecting section 306 is substantially strip-shaped. One end of the first connecting section 306 is electrically connected to one end of the first radiating section 303 away from the second radiating section 304. The other end of the first connecting section 306 extends a direction parallel to the second radiating section 304 and towards the third radiating section 305. The second connecting section 307 is substantially strip-shaped. One end of the second connecting section 307 is perpendicularly connected to the first connecting section 306 away from the first radiating section 304. The other end of the second connecting section 307 extends along a direction parallel to the first radiating section 303 and towards the second radiating section 304. The third connecting section 308 is substantially strip-shaped. The third connecting section 308 is connected to a junction of the first connecting section 306 and the second connecting section 307, extends along a direction parallel to the first radiating section 303 and towards the first side portion 116 until the third connecting section 308 is connected to the front frame 111. The third connecting section 308 is collinear with the second connecting section 307.

The fourth feed source 31 is positioned at the front frame 111 and is electrically connected to a junction of the first radiating section 303 and the first connecting section 306. The fourth feed source 31 can provide a current to the first radiating portion 301 and the second radiating portion 302 to activate a working mode, for example, the WIFI 2.4G mode and the WIFI 5G mode.

In this exemplary embodiment, when the antenna structure 200 works at the low frequency operation mode and the GPS operation mode, a current path distribution graph of the antenna structure 200 is consistent with the current path distribution graph of the antenna structure 100 shown in FIG. 9.

In this exemplary embodiment, when the antenna structure 200 works at the middle frequency operation mode, a current path distribution graph of the antenna structure 200 is consistent with the current path distribution graph of the antenna structure 100 shown in FIG. 10.

Figure 20:
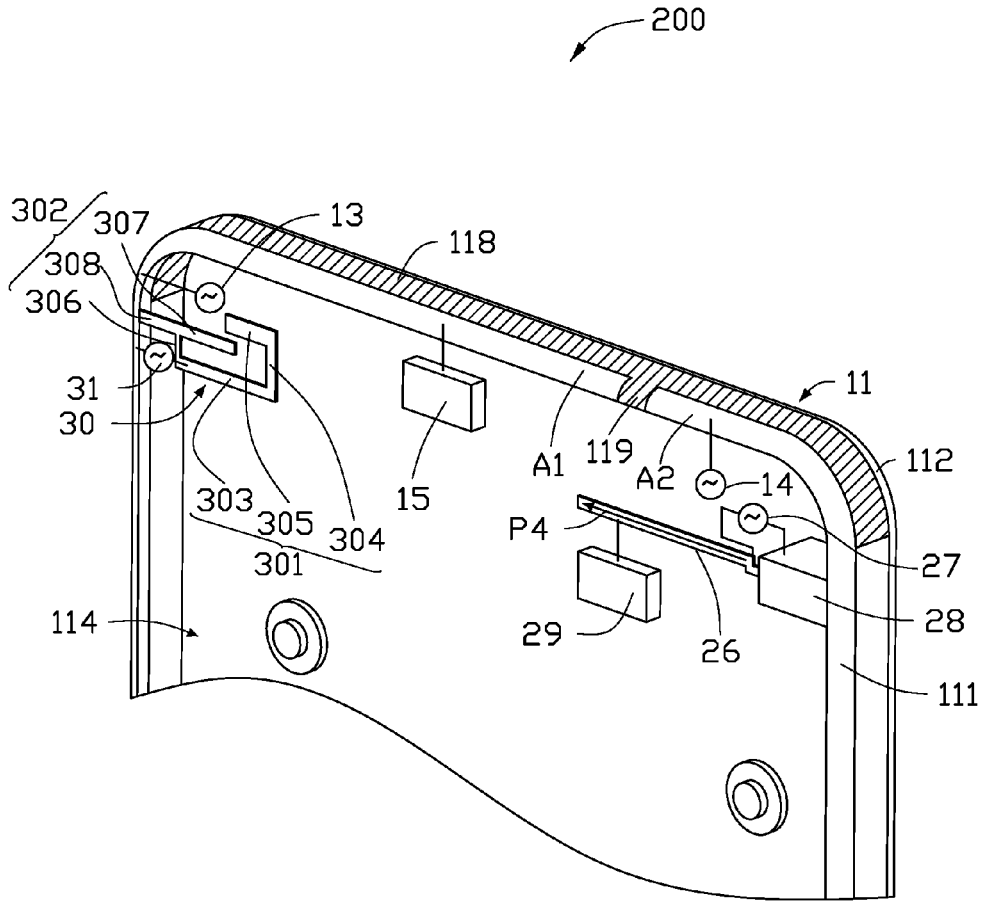
FIG. 20 is a current path distribution graph when the antenna structure of FIG. 16 works at a high frequency operation mode.

Per FIG. 20, when the current enters the first radiator 26 from the third feed source 27, the current flows to one end of the first radiator 26 away from the third feed source 27 (Per path P4) to activate a fourth mode to generate radiation signals in a fourth frequency band. In this exemplary embodiment, the fourth mode is a high frequency operation mode. Since the antenna structure 200 includes the second switching circuit 29, the high frequency operation mode can be switched through the second switching circuit 29, for example, the antenna structure 200 can be switched to an LTE-A Band 40 band (2300-2400 MHz) or LTE-A Band 41 (2496-2690 MHz), and the high frequency operation mode and middle frequency operation mode can be active simultaneously.

Figure 21:
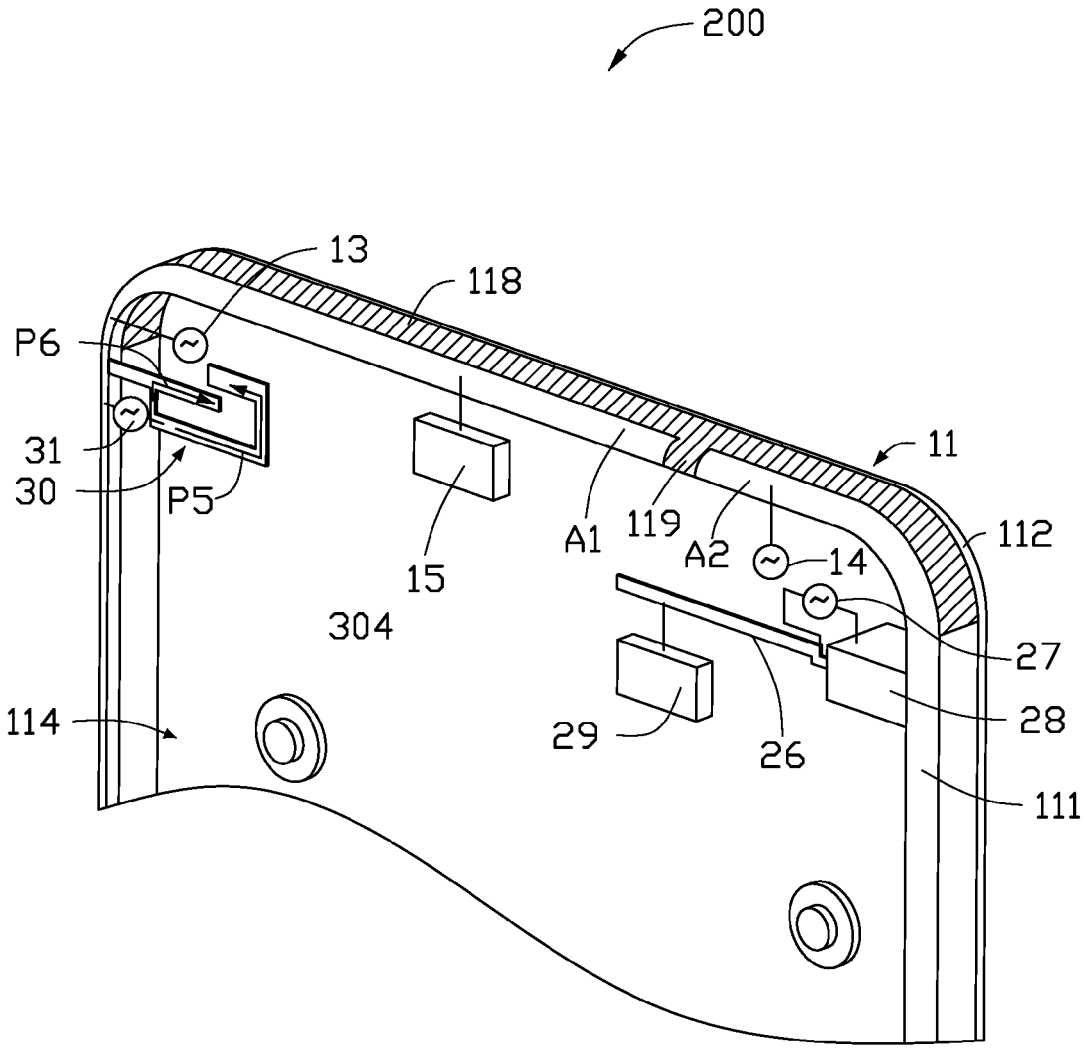
FIG. 21 is a current path distribution graph when the antenna structure of FIG. 16 works at a dual-band WIFI operation mode.

Per FIG. 21, when the current enters the second radiator 30 from the fourth feed source 31, the current flows to the first radiating section 303, the second radiating section 304, and the third radiating section 305 (Per path P5) to activate a fifth mode to generate radiation signals in a fifth frequency band. In this exemplary embodiment, the fifth mode is a WIFI 2.4G mode. When the current enters the second radiator 30 from the fourth feed source 31, the current also flows to the first connecting section 306 and the second connecting section 307 (Per path P6) to activate a sixth mode to generate radiation signals in a sixth frequency band. In this exemplary embodiment, the sixth mode is a WIFI 5G mode.

In this exemplary embodiment, when the antenna structure 200 works at the low frequency operation mode and the GPS operation mode, a scattering parameter graph and a radiating efficiency graph of the antenna structure 200 are consistent with the scattering parameter graph and a radiating efficiency graph of the antenna structure 100 shown in FIG. 10, FIG. 11, and FIG. 12.

Figure 22:
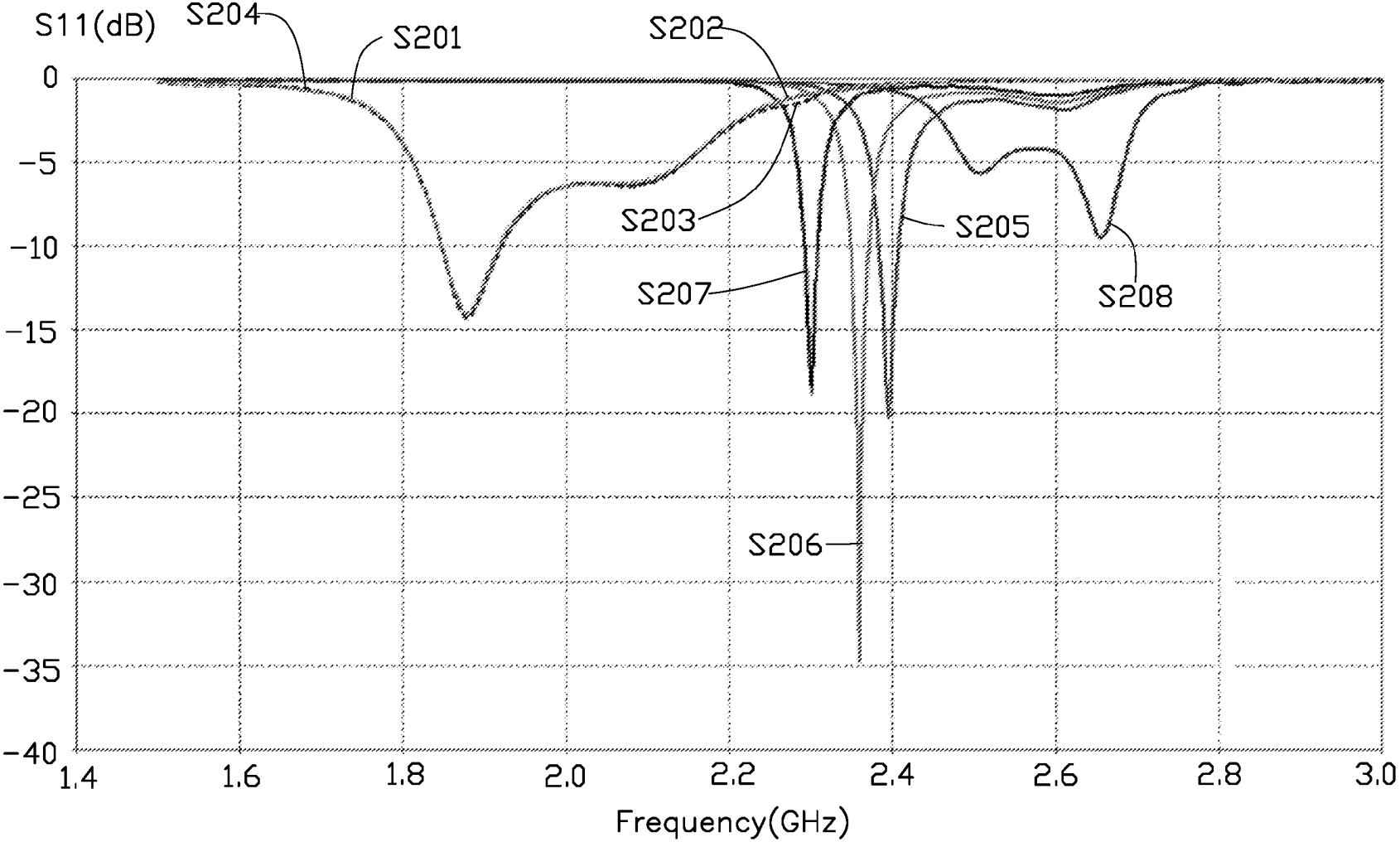
FIG. 22 is a scattering parameter graph when the antenna structure of FIG. 16 works at a middle frequency operation mode and a high frequency operation mode.

FIG. 22 illustrates a scattering parameter graph of the antenna structure 200, when the antenna structure 200 works at the middle frequency operation mode and the high frequency operation mode. Curve 201 illustrates a scattering parameter when the inductance value of the switching element 153 of the first switching circuit 15 is about 0.13 pf. Curve 202 illustrates a scattering parameter when the inductance value of the switching element 153 of the first switching circuit 15 is about 0.15 pf. Curve 203 illustrates a scattering parameter when the inductance value of the switching element 153 of the first switching circuit 15 is about 0.2 pf. Curve 204 illustrates a scattering parameter when the first switching circuit 15 is in an open-circuit state (that is, the first switching circuit 15 does not switch to any switching element 153). Curve 205 illustrates a scattering parameter when the inductance value of the switching element 153 of the second switching circuit 29 is about 0.13 pf. Curve 206 illustrates a scattering parameter when the inductance value of the switching element 153 of the second switching circuit 29 is about 0.15 pf. Curve 207 illustrates a scattering parameter when the inductance value of the switching element 153 of the second switching circuit 29 is about 0.2 pf. Curve 208 illustrates a scattering parameter when the second switching circuit 29 is in an open-circuit state (that is, the second switching circuit 29 does not switch to any switching element).

Figure 23:
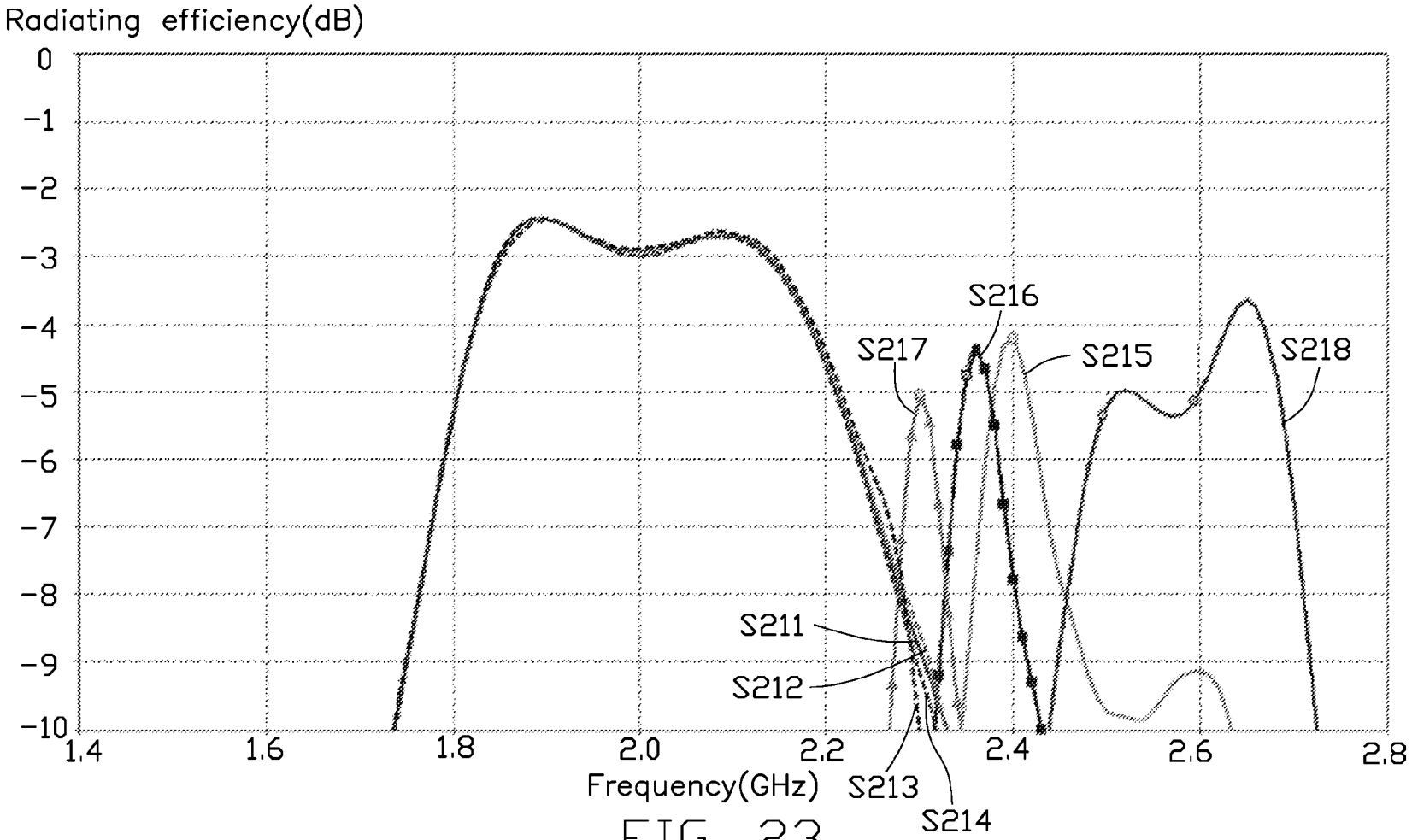
FIG. 23 is a radiating efficiency graph when the antenna structure of FIG. 16 works at a middle frequency operation mode and a high frequency operation mode.

FIG. 23 illustrates a radiating efficiency graph of the antenna structure 200, when the antenna structure 200 works at the middle frequency operation mode and the high frequency operation mode. Curve 211 illustrates a radiating efficiency when the inductance value of the switching element 153 of the first switching circuit 15 is about 0.13 pf. Curve 212 illustrates a radiating efficiency when the inductance value of the switching element 153 of the first switching circuit 15 is about 0.15 pf. Curve 213 illustrates a radiating efficiency when the inductance value of the switching element 153 of the first switching circuit 15 is about 0.2 pf. Curve 214 illustrates a radiating efficiency when the first switching circuit 15 is in an open-circuit state (that is, the first switching circuit 15 does not switch to any switching element 153). Curve 215 illustrates a radiating efficiency when the inductance value of the switching element 153 of the second switching circuit 29 is about 0.13 pf. Curve 216 illustrates a radiating efficiency when the inductance value of the switching element 153 of the second switching circuit 29 is about 0.15 pf. Curve 217 illustrates a radiating efficiency when the inductance value of the switching element 153 of the second switching circuit 29 is about 0.2 pf. Curve 218 illustrates a radiating efficiency when the second switching circuit 29 is in an open-circuit state (that is, the second switching circuit 29 does not switch to any switching element).

Figure 24:
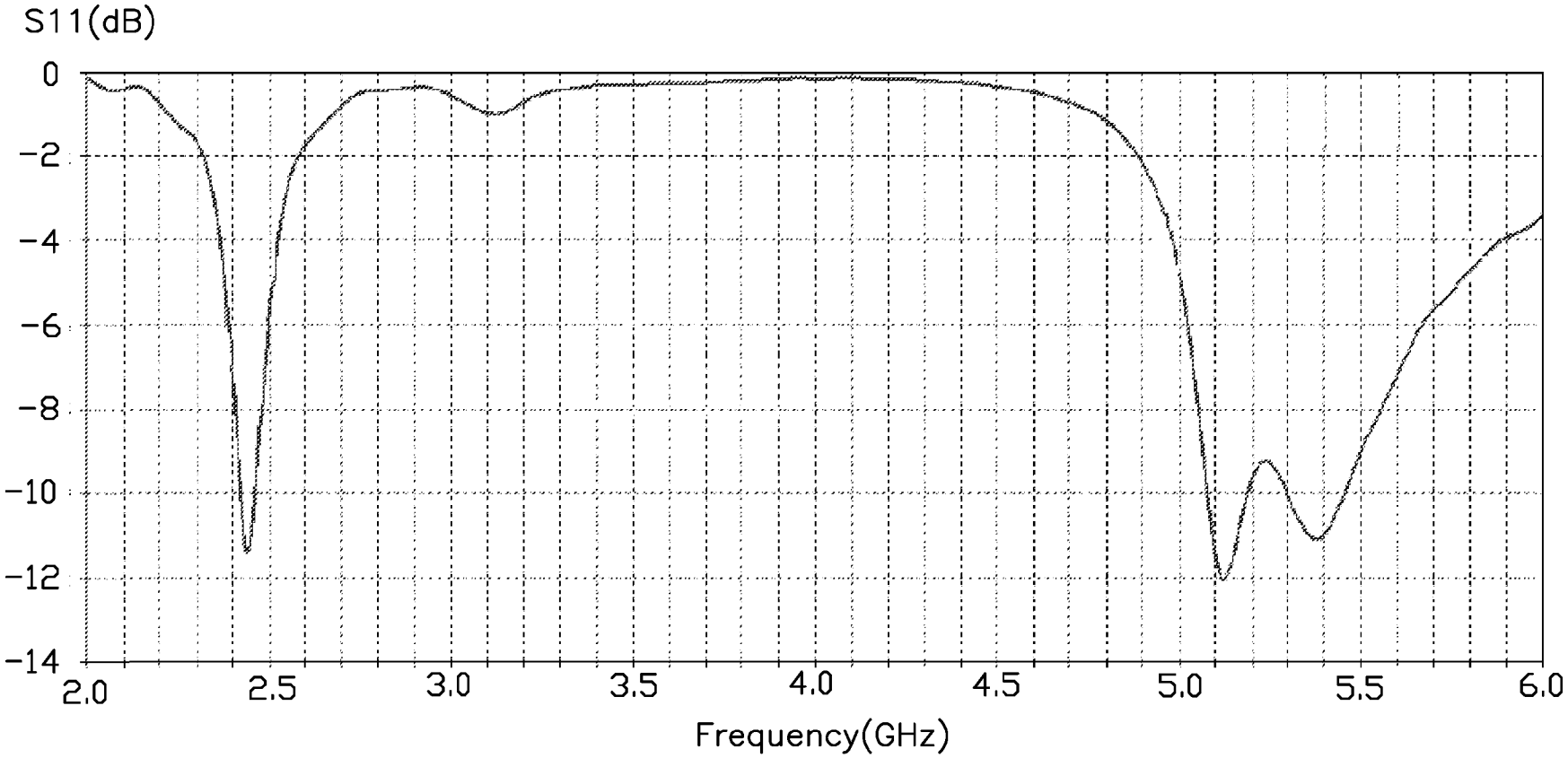
FIG. 24 is a scattering parameter graph when the antenna structure of FIG. 16 works at a WIFI 2.4G mode and a WIFI 5G mode.
Figure 25:
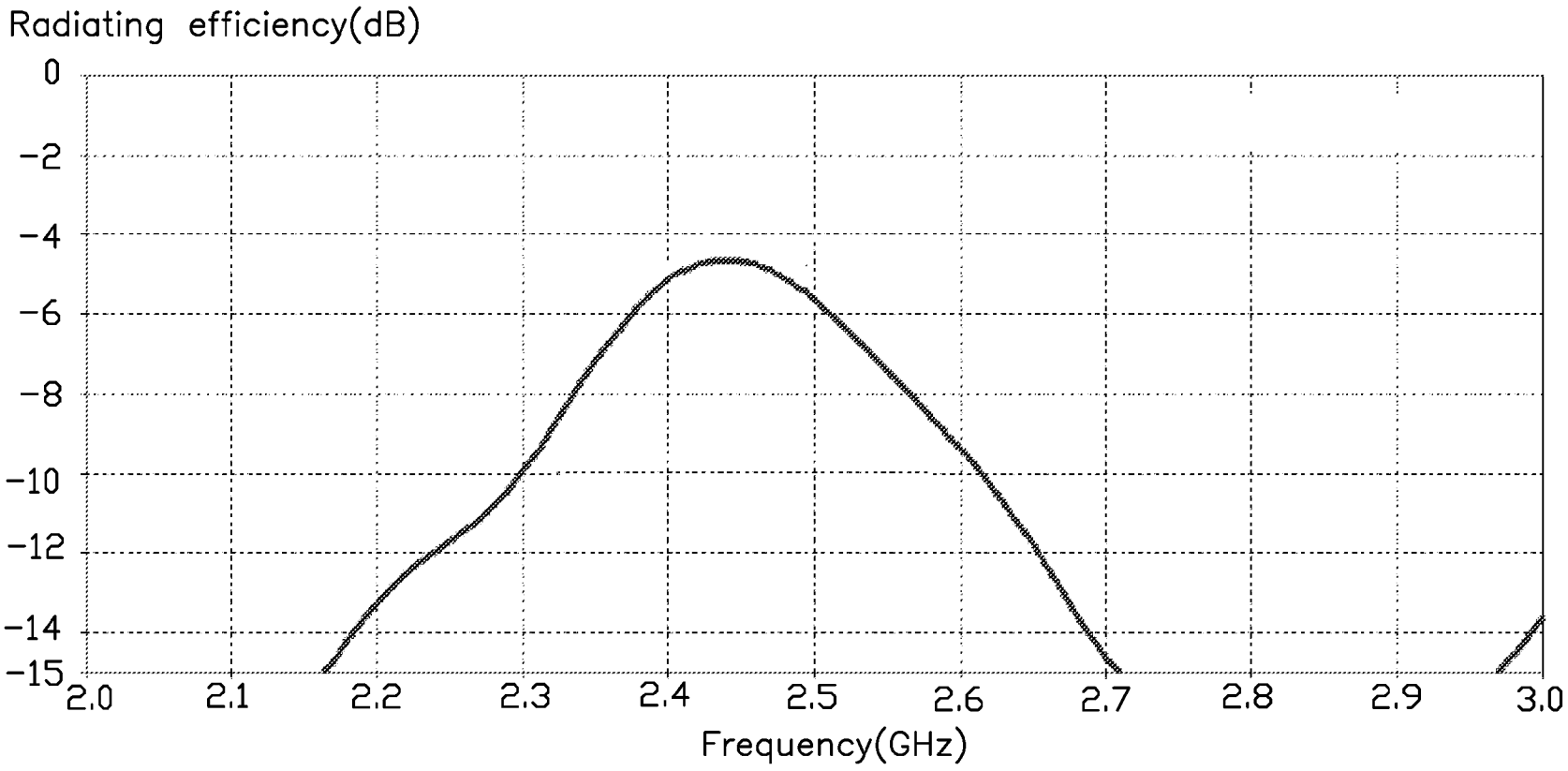
FIG. 25 is a radiating efficiency graph when the antenna structure of FIG. 16 works at a WIFI 2.4G mode.
Figure 26:
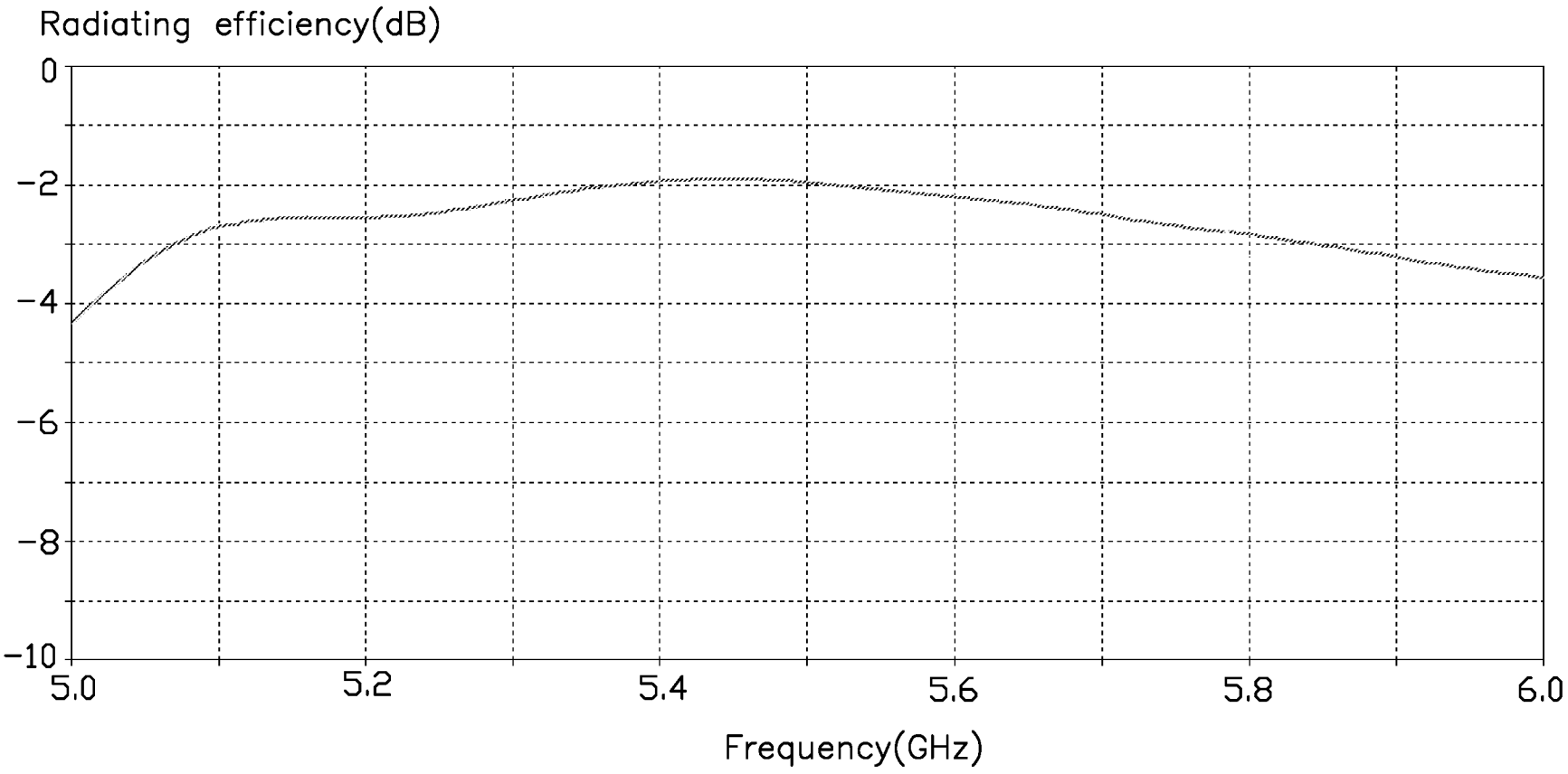
FIG. 26 is a radiating efficiency graph when the antenna structure of FIG. 16 works at a WIFI 5G mode.

FIG. 24 illustrates a scattering parameter graph of the antenna structure 200, when the antenna structure 200 works at the WIFI 2.4G band and WIFI 5G band. FIG. 25 illustrates a radiating efficiency graph of the antenna structure 200, when the antenna structure 200 works at the WIFI 2.4G band. FIG. 26 illustrates a radiating efficiency graph of the antenna structure 200, when the antenna structure 200 works at the WIFI 5G band.

In view of FIGS. 11 to 13 and FIGS. 22 to 26, the antenna structure 200 can work at a low frequency band, for example, LTE-A band 28 (703-803 MHz), LTE-A Band 5 (869-894 MHz), and LTE-A Band 8 (925-926 MHz). The antenna structure 200 can also work at the GPS band (1.575 GHz), the middle frequency band (1805-2170 MHz), the high frequency band (2300-2400 MHz and 2496-2690 MHz), and the WIFI 2.4/5G dual-frequency bands. That is, the antenna structure 200 can work at the low frequency band, the middle frequency band, the high frequency band, and the WIFI 2.4/5G dual-frequency bands, and when the antenna structure 200 works at these frequency bands, a working frequency satisfies a design of the antenna and also has a good radiating efficiency.

As described above, the long portion A1 can activate a first mode to generate radiation signals in a low frequency band, the short portion A2 can activate a third mode to generate radiation signals in a middle frequency band and a high frequency band. The first radiator 26 can activate a fourth mode to generate radiation signals in a high frequency band. The wireless communication device 400 can use the first radiator 26, through carrier aggregation (CA) technology of LTE-A, to receive or send wireless signals at multiple frequency bands simultaneously. In detail, the wireless communication device 400 can use the CA technology and use at least two of the long portion A1, the short portion A2, and the first radiator 26 to receive or send wireless signals at multiple frequency bands simultaneously.

In other exemplary embodiments, a location of the first radiator 26 and the second switching circuit 29 can be exchanged with a location of the second radiator 30. One end of the first radiator is electrically connected to the front frame 111. The other end of the first radiator 26 extends towards the second side portion 117. One end of the second switching circuit 29 is electrically connected to the first radiator 26 and the other end of the second switching circuit 29 is electrically connected to the backboard 112. The third feed source 27 is positioned on the front frame 111 and is electrically connected to the first radiator 26. The second radiator 30 is positioned in the receiving space 114 and is positioned adjacent to the short portion A2. One end of the third connecting section 308 of the second radiator 30 connected to front frame 111 is changed to be electrically connected to the isolation portion 28. One end of the fourth feed source 31 is electrically connected to a junction of the first radiating section 303 and the first connecting section 306. The other end of the fourth feed source 31 is electrically connected to the isolation portion 28.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a metallic member, the metallic member comprising a front frame, a backboard, and a side frame, the side frame being positioned between the front frame and the backboard, the side frame comprising at least a top portion, a first side portion, and a second side portion, the first side portion and the second side portion being respectively connected to two ends of the top portion;

a first radiator; and an isolating portion electrically connected to the first radiator;

wherein the side frame defines a slot, the slot is defined on the top portion;

wherein the front frame defines a gap, the gap communicates with the slot and extends across the front frame; and wherein a first portion of the front frame from a first side of the gap to a first end of the slot forms a short portion, the first radiator is positioned adjacent to the short portion, and the isolation portion improves isolation between the short portion and the first radiator.

2. The antenna structure of claim 1, wherein the slot and the gap are both filled with insulating material.

3. The antenna structure of claim 1, wherein a second portion of the front frame from a second side of the gap to a second end of the slot forms a long portion, the long portion is longer than the short portion; the antenna structure further comprises a first feed source, the first feed source is electrically connected to the long portion, when a current enters the long portion from the first feed source, the current flows through the long portion and towards the gap to activate a first mode for generating radiation signals in a first frequency band.

4. The antenna structure of claim 3, further comprising a first switching circuit, wherein the first switching circuit comprises a switching unit and a plurality of switching elements, the switching unit is electrically connected to the long portion, the switching elements are connected in parallel to each other, one end of each switching element is electrically connected to the switching unit, and the other end of each switching element is electrically connected to the backboard; through controlling the switching unit to switch, the long portion is switched to different switching elements and the first frequency band is adjusted.

5. The antenna structure of claim 4, wherein the first switching circuit further comprises a resonance circuit, the resonance circuit is configured to control the long portion to activate a second mode to generate radiation signals in a second frequency band, a frequency of the second frequency band is higher than a frequency of the first frequency band.

6. The antenna structure of claim 5, wherein the first switching circuit comprises only one resonance circuit, the resonance circuit is electrically connected between the long portion and the backboard.

7. The antenna structure of claim 5, wherein the first switching circuit comprises a plurality of resonance circuits, a number of the resonance circuits is equal to a number of the switching elements, each resonance circuit is electrically connected to one of the switching elements in parallel between the switching unit and the backboard, when the first frequency band is adjusted, the plurality of resonance circuits keeps the second frequency band unchanged.

8. The antenna structure of claim 5, wherein the first switching circuit comprises a plurality of resonance circuits, a number of the resonance circuits is equal to a number of the switching elements, each resonance circuit is electrically connected to one of the switching elements in parallel between the switching unit and the backboard, when the first frequency band is adjusted, the plurality of resonance circuits correspondingly adjusts the second frequency band.

9. The antenna structure of claim 3, further comprising a second feed source, wherein the second feed source is electrically connected to the short portion, when a current enters the short portion from the second feed source, the current flows to the front frame, the second side portion, and the backboard to activate a third mode for generating radiation signals in a third frequency band, and a frequency of the third frequency band is higher than a frequency of the first frequency band.

10. The antenna structure of claim 3, further comprising a third feed source, wherein one end of the first radiator is electrically connected to the isolation portion and the other end of the first radiator extends towards the first side portion; one end of the third feed source is electrically connected to the first radiator and the other end of the third feed source is electrically connected to the isolation portion; when a current enters the first radiator from the third feed source, the first radiator activates a fourth mode for generating radiation signals in a fourth frequency band.

11. The antenna structure of claim 10, further comprising a second switching circuit, wherein one end of the second switching circuit is electrically connected to the first radiator and the other end of the second switching circuit is electrically connected to backboard, and the second switching circuit is configured to adjust the fourth frequency band.

12. The antenna structure of claim 10, further comprising a second radiator and a fourth feed source, wherein the second radiator is positioned adjacent to the long portion, the fourth feed source is positioned at the front frame and is electrically connected to the second radiator; when a current enters the second radiator from the fourth feed source, the second radiator activates a fifth mode for generating radiation signals in a fifth frequency band and a sixth mode for generating radiation signals in a sixth frequency band, a frequency of the sixth frequency band is higher than a frequency of the fifth frequency band.

13. The antenna structure of claim 12, wherein the second radiator comprises a first radiating portion, the first radiating portion comprises first radiating section, a second radiating section, and a third radiating section connected in that order; the first radiating section is positioned parallel to the top portion; one end of the second radiating section is perpendicularly connected to the end of the first radiating section adjacent to the second side portion, the other end of the second radiating section extends along a direction parallel to the second side portion and towards the top portion; one end of the third radiating section is connected to the end of the second radiating section away from the first radiating section, the other end of the third radiating section extends along a direction parallel to the first radiating section and towards the first side portion; and when a current enters the second radiator from the fourth feed source, the current flows to the first radiating section, the second radiating section, and the third radiating section to activate the fifth mode.

14. The antenna structure of claim 13, wherein the second radiator further comprises a second radiating portion, the second radiating portion comprises a first connecting section, a second connecting section, and a third connecting section, one end of the first connecting section is electrically connected to the end of the first radiating section away from the second radiating section, the other end of the first connecting section extends a direction parallel to the second radiating section and towards the third radiating section; one end of the second connecting section is perpendicularly connected to the end of the first connecting section away from the first radiating section, the other end of the second connecting section extends along a direction parallel to the first radiating section and towards the second radiating section; the third connecting section is connected to a junction of the first connecting section and the second connecting section, the third connecting section extends along a direction parallel to the first radiating section and towards the first side portion until the third connecting section is connected to the front frame, the third connecting section is collinear with the second connecting section; and when a current enters the second radiator from the fourth feed source, the current flows to the first connecting section and the second connecting section to activate the sixth mode.

15. The antenna structure of claim 10, wherein a wireless communication device uses at least two of the long portion, the short portion, and the first radiator to receive or send wireless signals at multiple frequency bands simultaneously through CA technology of LTE-A.

16. The antenna structure of claim 1, wherein the isolating portion is positioned on the backboard and extends from the second side portion towards the first side portion.

17. The antenna structure of claim 1, further comprising a metallic frame, wherein the metallic frame is positioned in a receiving space formed by the front frame, the backboard, and the side frame; the metallic frame is connected to the metallic member; the isolating portion is positioned on the backboard and extends from the second side portion towards the first side portion, the isolating portion is connected to or spaced apart from the metallic frame.

18. The antenna structure of claim 1, further comprising a metallic frame, wherein the metallic frame is positioned in a receiving space formed by the front frame, the backboard, and the side frame; the metallic frame is connected to the metallic member; the isolating portion is positioned at one side of the metallic frame, and the isolating portion is spaced apart from both the second side portion and the backboard.

19. The antenna structure of claim 1, wherein the backboard is an integral and single metallic sheet, the backboard defines holes for exposing a camera lens and a flash light.

20. The antenna structure of claim 1, wherein a wireless communication device uses the first radiator to receive or send wireless signals at multiple frequency bands simultaneously through carrier aggregation (CA) technology of Long Term Evolution Advanced (LTE-A).

21. A wireless communication device comprising:

an antenna structure, the antenna structure comprising:

a metallic member, the metallic member comprising a front frame, a backboard, and a side frame, the side frame being positioned between the front frame and the backboard, the side frame comprising at least a top portion, a first side portion, and a second side portion, the first side portion and the second side portion being respectively connected to two ends of the top portion;

a first radiator; and an isolating portion electrically connected to the first radiator;

wherein the side frame defines a slot, the slot is defined on the top portion;

wherein the front frame defines a gap, the gap communicates with the slot and extends across the front frame; and wherein a first portion of the front frame from a first side of the gap to a first end of the slot forms a short portion, the first radiator is positioned adjacent to the short portion, and the isolation portion improves isolation between the short portion and the first radiator.

22. The wireless communication device of claim 21, further comprising a display, wherein the front frame, the backboard, and the side frame cooperatively form a metal housing of the wireless communication device, the front frame defines an opening, the display is received in the opening, a display surface of the display is exposed at the opening and is positioned parallel to the backboard.

23. The wireless communication device of claim 21, wherein the slot and the gap are both filled with insulating material.

24. The wireless communication device of claim 21, wherein a second portion of the front frame from a second side of the gap to a second end of the slot forms a long portion, the long portion is longer than the short portion; the antenna structure further comprises a first feed source, the first feed source is electrically connected to the long portion, when a current enters the long portion from the first feed source, the current flows through the long portion and towards the gap to activate a first mode for generating radiation signals in a first frequency band.

25. The wireless communication device of claim 24, wherein the antenna structure further comprises a first switching circuit, the first switching circuit comprises a switching unit and a plurality of switching elements, the switching unit is electrically connected to the long portion, the switching elements are connected in parallel to each other, one end of each switching element is electrically connected to the switching unit, and the other end of each switching element is electrically connected to the backboard; through controlling the switching unit to switch, the long portion is switched to different switching elements and the first frequency band is adjusted.

26. The wireless communication device of claim 25, wherein the first switching circuit further comprises a resonance circuit, the resonance circuit is configured to control the long portion to activate a second mode to generate radiation signals in a second frequency band, a frequency of the second frequency band is higher than a frequency of the first frequency band.

27. The wireless communication device of claim 26, wherein the first switching circuit comprises only one resonance circuit, the resonance circuit is electrically connected between the long portion and the backboard.

28. The wireless communication device of claim 26, wherein the first switching circuit comprises a plurality of resonance circuits, a number of the resonance circuits is equal to a number of the switching elements, each resonance circuit is electrically connected to one of the switching elements in parallel between the switching unit and the backboard, when the first frequency band is adjusted, the plurality of resonance circuits keeps the second frequency band unchanged.

29. The wireless communication device of claim 24, wherein the first switching circuit comprises a plurality of resonance circuits, a number of the resonance circuits is equal to a number of the switching elements, each resonance circuit is electrically connected to one of the switching elements in parallel between the switching unit and the backboard, when the first frequency band is adjusted, the plurality of resonance circuits correspondingly adjusts the second frequency band.

30. The wireless communication device of claim 24, the antenna structure further comprises a second feed source, the second feed source is electrically connected to the short portion, when a current enters the short portion from the second feed source, the current flows to the front frame, the second side portion, and the backboard to activate a third mode for generating radiation signals in a third frequency band, and a frequency of the third frequency band is higher than a frequency of the first frequency band.

31. The wireless communication device of claim 24, the antenna structure further comprises a third feed source, one end of the first radiator is electrically connected to the isolation portion and the other end of the first radiator extends towards the first side portion; one end of the third feed source is electrically connected to the first radiator and the other end of the third feed source is electrically connected to the isolation portion; when a current enters the first radiator from the third feed source, the first radiator activates a fourth mode for generating radiation signals in a fourth frequency band.

32. The wireless communication device of claim 31, the antenna structure further comprises a second switching circuit, one end of the second switching circuit is electrically connected to the first radiator and the other end of the second switching circuit is electrically connected to backboard, and the second switching circuit is configured to adjust the fourth frequency band.

33. The wireless communication device of claim 31, wherein the antenna structure further comprises a second radiator and a fourth feed source, the second radiator is positioned adjacent to the long portion, the fourth feed source is positioned at the front frame and is electrically connected to the second radiator; when a current enters the second radiator from the fourth feed source, the second radiator activates a fifth mode for generating radiation signals in a fifth frequency band and a sixth mode for generating radiation signals in a sixth frequency band, a frequency of the sixth frequency band is higher than a frequency of the fifth frequency band.

34. The wireless communication device of claim 33, wherein the second radiator comprises a first radiating portion, the first radiating portion comprises first radiating section, a second radiating section, and a third radiating section connected in that order; the first radiating section is positioned parallel to the top portion; one end of the second radiating section is perpendicularly connected to the end of the first radiating section adjacent to the second side portion, the other end of the second radiating section extends along a direction parallel to the second side portion and towards the top portion; one end of the third radiating section is connected to the end of the second radiating section away from the first radiating section, the other end of the third radiating section extends along a direction parallel to the first radiating section and towards the first side portion; and when a current enters the second radiator from the fourth feed source, the current flows to the first radiating section, the second radiating section, and the third radiating section to activate the fifth mode.

35. The wireless communication device of claim 34, wherein the second radiator further comprises a second radiating portion, the second radiating portion comprises a first connecting section, a second connecting section, and a third connecting section, one end of the first connecting section is electrically connected to the end of the first radiating section away from the second radiating section, the other end of the first connecting section extends a direction parallel to the second radiating section and towards the third radiating section; one end of the second connecting section is perpendicularly connected to the end of the first connecting section away from the first radiating section, the other end of the second connecting section extends along a direction parallel to the first radiating section and towards the second radiating section; the third connecting section is connected to a junction of the first connecting section and the second connecting section, the third connecting section extends along a direction parallel to the first radiating section and towards the first side portion until the third connecting section is connected to the front frame, the third connecting section is collinear with the second connecting section; and when a current enters the second radiator from the fourth feed source, the current flows to the first connecting section and the second connecting section to activate the sixth mode.

36. The wireless communication device of claim 31, wherein the wireless communication device uses at least two of the long portion, the short portion, and the first radiator to receive or send wireless signals at multiple frequency bands simultaneously through CA technology of LTE-A.

37. The wireless communication device of claim 21, wherein the isolating portion is positioned on the backboard and extends from the second side portion towards the first side portion.

38. The wireless communication device of claim 21, the antenna structure further comprises a metallic frame, the metallic frame is positioned in a receiving space formed by the front frame, the backboard, and the side frame; the metallic frame is connected to the metallic member; the isolating portion is positioned on the backboard and extends from the second side portion towards the first side portion, the isolating portion is connected to or spaced apart from the metallic frame.

39. The wireless communication device of claim 21, wherein the antenna structure further comprises a metallic frame, the metallic frame is positioned in a receiving space formed by the front frame, the backboard, and the side frame; the metallic frame is connected to the metallic member; the isolating portion is positioned at one side of the metallic frame, and the isolating portion is spaced apart from both the second side portion and the backboard.

40. The wireless communication device of claim 21, wherein the backboard is an integral and single metallic sheet, the backboard defines holes for exposing a camera lens and a flash light.

41. The wireless communication device of claim 21, wherein the wireless communication device uses the first radiator to receive or send wireless signals at multiple frequency bands simultaneously through carrier aggregation (CA) technology of Long Term Evolution Advanced (LTE-A).

* * * * *